US008170464B2

(12) United States Patent
Ueda

(10) Patent No.: US 8,170,464 B2
(45) Date of Patent: May 1, 2012

(54) IMAGE FORMING APPARATUS CAPABLE OF PREVENTING MISMATCHING OF PUNCHED HOLE POSITION AND BINDING DIRECTION

(75) Inventor: Akio Ueda, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 858 days.

(21) Appl. No.: 11/870,722

(22) Filed: Oct. 11, 2007

(65) Prior Publication Data

US 2008/0181699 A1 Jul. 31, 2008

(30) Foreign Application Priority Data

Dec. 18, 2006 (JP) ..... 2006-339921

(51) Int. Cl.
*G03G 15/00* (2006.01)

(52) U.S. Cl. ..... 399/408; 399/407; 399/81

(58) Field of Classification Search ..... 399/408, 399/407, 410, 81, 85
See application file for complete search history.

(56) References Cited

U.S. PATENT DOCUMENTS 7,120,382 B2 * 10/2006 Shimizu et al. ..... 399/392
7,424,237 B2 * 9/2008 Ushio et al. ..... 399/82
2002/0051651 A1 * 5/2002 Yamada et al. ..... 399/81
2005/0105116 A1 5/2005 Kobashi

FOREIGN PATENT DOCUMENTS

JP 07-131630 A 5/1995
JP 2002-144665 A 5/2002
JP 2005-151034 A 6/2005

OTHER PUBLICATIONS

Japanese Office Action dated Feb. 18, 2011 (and English translation thereof) in counterpart Japanese Application No. 2006-339921.

* cited by examiner

*Primary Examiner* — Matthew G Marini
(74) *Attorney, Agent, or Firm* — Holtz, Holtz, Goodman & Chick, PC

(57) ABSTRACT

An image forming apparatus to form an image on a sheet media, including: a memory section which memorizes a position of holes previously punched on the sheet media; an operation section via which the sheet media to be used for image formation, a double-surface print operation and a binding direction are selected; and a control section which determines whether the position of the holes previously punched on the selected sheet media is the same as the binding direction selected via the operation section, after the sheet media carrying the holes and the double-surface print are selected via the operation section, wherein the control section interrupts starting operation of the image formation, if the position of the holes previously punched on the selected sheet media is not the same as the selected binding direction.

7 Claims, 16 Drawing Sheets

FIG. 12

189

| DOCUMENT | TRANSFER SHEET | BINDING DIRECTION OF DOUBLE SURFACES OUTPUT | COMBINATION |
|---|---|---|---|
| A<br>PORTRAIT | LEF LEFT PUNCH LEF RIGHT PUNCH | LEFT, RIGHT | OK |
| | | UPPER | NG |
| | LEF UPPER PUNCH | LEFT, RIGHT | NG |
| | | UPPER | OK |
| | SEF LEFT PUNCH SEF RIGHT PUNCH | LEFT, RIGHT | NG |
| | | UPPER | OK |
| | SEF UPPER PUNCH | LEFT, RIGHT | OK |
| | | UPPER | NG |
| A<br>LANDSCAPE | LEF LEFT PUNCH LEF RIGHT PUNCH | LEFT, RIGHT | NG |
| | | UPPER | OK |
| | LEF LEFT PUNCH | LEFT, RIGHT | OK |
| | | UPPER | NG |
| | SEF LEFT PUNCH SEF RIGHT PUNCH | LEFT, RIGHT | OK |
| | | UPPER | NG |
| | SEF UPPER PUNCH | LEFT, RIGHT | NG |
| | | UPPER | OK |

IMAGE FORMING APPARATUS CAPABLE OF PREVENTING MISMATCHING OF PUNCHED HOLE POSITION AND BINDING DIRECTION

This application is based on Japanese Patent Application No. 2006-339921 filed on Dec. 18, 2006 with the Japanese Patent Office, the entire content of which is hereby incorporated by reference.

FIELD OF THE INVENTION

The present invention relates to an image forming apparatus which forms an image on sheet media based on image data.

BACKGROUND OF THE INVENTION

Various types of image forming apparatuses are well known which form an image on sheet media based on the image data. For example, listed are a printer which forms the image data, transmitted from a computer, on the sheet media, and a copy machine which reads the image from a surface of a document and copies it. Further, listed are compound machines, in which a printer and a copy machine are combined, or a compound machine, in which a facsimile machine and a scanner are further added to the former.

Various types of sheet media are accommodated in a sheet storing device which is installed in or pre-positioned to said image forming apparatus, and any type of sheet media is picked up for image formation. Listed sheet media are, for example, light weight coated paper for hand bills, art paper for trade catalogs, coating paper, cast paper, and bond paper, as well as paper having punched holes on its one side for use in loose-leaf binders.

The operator may select one type from among the stored sheet medias, select either a single-surface printing operation or double-surface printing operation, and may further select a binding direction, after which the operator allows the image forming apparatus to form the image in the desired format. Unexamined Japanese Patent Application Publication No. 7-131,630 discloses the binding direction for binding of a number of printed sheets, whereby binding can be selected among top binding, bottom binding, left binding, right binding, long edge binding or short edge binding. For the double-surface printing operation, the image on text to be printed on the second surface is rotated based on the selected binding. Further this technology discloses that the images are rotated based on the direction of the document to be read, or the direction of the sheet media.

For example, when sheet media is conveyed parallel to its long edge, for right or left side binding, the image to be printed on the second surface does not need to be rotated, however, for the top binding, only after the image to be printed on the second surface is rotated 180°, image formation is conducted. That is, the top of the image is aligned with the bottom of the second surface, for image formation.

However, if a sheet media carrying punched holes is selected as sheet media for the image formation, the position of the punched holes may not match the selected binding direction.

That is, in the case of an LEF (being long edge feed) transfer sheet, a sheet carrying punched holes on one of long edges, is selected, the binding direction may be any one of the left or right binding direction (being right side binding for LEF transfer sheet). However, if an experienced operator selects top binding (being the left side binding for an LED transfer sheet, the image on the second surface is rotated 180°, whereby if the sheets are bound using the punched holes, the image printed on the second surface becomes reversed for a person reading it, which becomes a major problem.

SUMMARY OF THE INVENTION

Item 1: As an aspect of the present invention, the image forming apparatus includes:

a memory section which memorizes positions of holes previously punched on a sheet media;

an operation section which selects a sheet media to be used for image formation, double-surface printing and a binding direction; and a control section which determines whether the position of the punched holes on the selected sheet media matches the selected binding direction, after sheet media previously punched and double-surface printing are selected, and if the positions of the punched holes on the selected sheet media do not match the selected binding direction, the control section prevents the starting operation of the image formation.

Item 2: As an aspect of the present invention, the image forming apparatus includes:

a memory section which memorizes position of holes previously punched on a sheet media;

an operation section which selects a sheet media to be used for image formation, double-surface printing and binding direction; and a control section which determines whether the positions of the punched holes on the selected sheet media matches the selected binding direction, after sheet media previously punched and the double-surface printing are selected, and if the position of the punched holes on the selected sheet media does not match the selected binding direction, the control section automatically sets the binding direction so as to match the position of the punched holes, and then conducts image formation.

Item 3: As an aspect of the present invention, the image forming apparatus includes:

a memory section which memorizes position of holes previously punched on a sheet media;

an operation section which selects a sheet media to be used for image formation, double-surface printing and a binding direction; and a determining section which determines whether the positions of the punched holes on the selected sheet media matches the selected binding direction, after sheet media carrying punched holes and the double-surface printing are selected, a display section which displays a screen to remind whether automatic setting of the binding direction is to be conducted to match the positions of the punched holes when the determining section determines the position of the holes is not the same as the binding direction, and a control section which conducts the automatic setting of the binding direction to match the position of the punched holes, after which the control section conducts the image formation.

BRIEF DESCRIPTION OF THE DRAWINGS

FIG. 12 is an equality determining table showing the alteration of allowable output setting information and the alteration of prohibited output setting information, based on sheet state information.

DETAILED DESCRIPTION OF THE INVENTION

Figure 1:
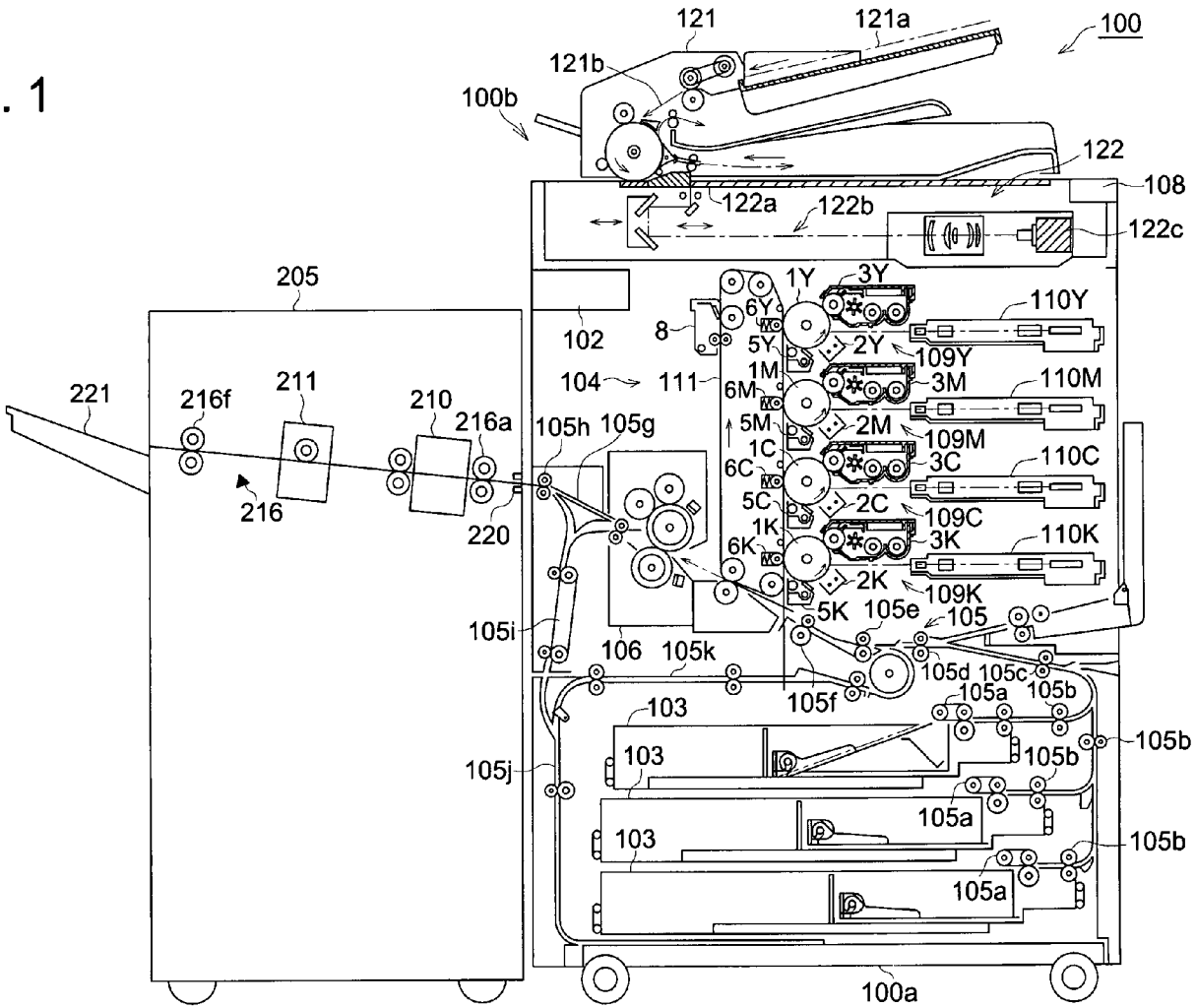
FIG. 1 shows the overall structure of an image forming system relating to the present invention.

The several embodiments of the present invention will now be detailed while referring to the drawings.

The First Embodiment

FIG. 1 shows the overall structure of image forming apparatus 100, in which mismatching of the punched hole position and the binding direction is prevented.

Image forming apparatus 100 is an electro-photographic printing machine in which after toner image for each color is formed based on any image data, the toner image for each color is superimposed to become a color image. Image forming apparatus 100 is structured of apparatus main body 100*a* and image reading device 100*b* installed on apparatus main body 100*a*.

When operation panel 108, also mounted on apparatus main body 100*a*, is operated by an operator, image reading device 100*b* reads the image of the document, and apparatus main body 100*a* forms a printed image on a sheet media. Or when image data is inputted through a terminal on a network, apparatus main body 100*a* forms a printed image on a sheet media. Image forming apparatus 100 relating to the first embodiment reminds re-setting of the binding direction, if the binding direction which was set by the operator does not match the previously punched holes, and suspends image formation.

Book binding apparatus 205 can be electrically and mechanically combined to image forming apparatus 100. Book binding apparatus 205 bundles the sheets on which the images have been formed by image forming apparatus 100, and conducts various post-finishing operations, such as a stapler process, a shifting process and a hole punching process, on the bundled sheets.

Image reading device 100*b* is structured of document image scanning exposure device 122 which optically reads the image formed on the document and converts the read image to analog signals, and automatic document feeder (being ADF) 121 which conveys the document to document image scanning exposure device 122.

Automatic document feeder 121 supplies the documents to document image scanning exposure device 122, whereby plural documents, placed on document table 121*a*, are conveyed one by one to document image scanning exposure device 122 by conveyance section 121*b*.

Document image scanning exposure device 122 is structured of platen glass 122*a*, optical system 122*b*, including a light source, such as a Xenon lamp, mirrors and lenses, and CCD (being a charge-coupled device) image sensor 122*c*.

Optical system 122*b* conducts scanning exposure onto the document which is conveyed by automatic document feeder 121 and placed on platen glass 122*b*, a light path of light rays, emitted from the light source and reflected from the document, is changed by the mirrors, and the light rays are concentrated onto CCD image sensor 122*c* through the lenses. After CCD image sensor 122*c* receives the light rays reflected from the document, the light rays are converted to analog signals.

Sheet medias storing section 103 to accommodate sheet media and image output section 104 to output the image onto sheet media are disposed in apparatus main body 100*a*. Conveyance path 105, which supplies sheet media from sheet media storing section 103 to image output section 104, is disposed between sheet media storing section 103 and image output section 104. Fixing device 106 is disposed after image output section 104. In apparatus main body 100*a*, sheet media is conveyed from sheet medias storing section 103 to image output section 104 through conveyance path 105, after the image is formed onto sheet media on image forming section 104, the image is fixed by fixing device 106, and sheet media carrying the fixed image is ejected from apparatus main body 100*a*.

Further, control unit 102 is disposed in apparatus main body 100*a*, to totally control image forming apparatus 100 and book binding apparatus 205.

Sheet medias storing section 103, shaped to be a tray or a box, can be drawn along rails, disposed on the lower section, from apparatus main body 100*a* to the outside. Generally, plural sheet medias storing sections 103, 103, 103 - - - are disposed. In each sheet medias storing section 103, 103, 103 - - - , A3, A4, or B5 sized sheets can be stored in both lengthwise and widthwise directions. Further, as the types of sheet medias, stored are light weight coated paper for hand bills, art paper for trade catalogs, coating paper, cast paper, and bond paper, as well as paper having punched holes on its one side like a loose leaf.

Sheet media is conveyed from sheet medias storing section 103 through conveyance path 105, and conveyed to book binding apparatus 205 through image output section 104 and fixing device 106. Said conveyance path 105 is formed of plural paired rollers disposed at a predetermined distance. The line of disposed paired rollers forms a conveyance line of sheet media. Said paired rollers nip sheet media and rotate so that sheet media is conveyed to the next paired rollers.

Feed-out roller 105*a* and sheet supplying roller 105*b*, disposed in the vicinity of sheet storing section 103, pick up sheet media from sheet storing section 103. Conveyance rollers 105*c*, 105*d* and 105*e*, and registration roller 105*f* are disposed between sheet supplying roller 105*b* and image output section 104 in this order, which convey said picked-out sheet media to image output section 104. Registration roller 105*f* temporarily stops sheet media to regulate the leading edge of sheet media, after which conveys sheet media to image output section 104.

Fork path 105*g*, disposed at the backward position of fixing section 106, conveys sheet media having passed through fixing section 106, to an ejection side or a circulating side. Sheet ejection roller 105*h* is disposed at the ejection side of fork path 105*g*, to eject sheet media to the exterior, and conveys sheet media to book binding apparatus 205.

Circulation path 105*i*, reversing conveyance path 105*j* and sheet re-supplying path 105*k* are disposed at the circulation side of fork path 105*g*. For forming the image on the double surfaces of sheet media, after the images are formed on a first surface by image output section 104, sheet media is conveyed to reversing conveyance path 105*j* through circulation path 105*i*, where sheet media is reversed, after which sheet media is conveyed to conveyance roller 105*e* through sheet re-supplying path 105*k*.

Image output section 104 is structured of image forming units 109Y, 109M, 109C and 109K, semiconductor laser devices 110Y, 110M, 110C and 110 K, and intermediate transfer belt 111 which is an endless belt and is used in common for each color.

Image forming unit 109Y and semiconductor laser device 110Y, image forming unit 109M and semiconductor laser device 110M, image forming unit 109C and semiconductor laser device 110C, and image forming unit 109K and semiconductor laser device 110K, each forms a yellow image, a magenta image, a cyan image and a black image, respectively.

Image forming unit 109Y includes photoconductive drum 1Y, electrostatic-charging section 2Y, developing section 3Y and cleaning section 5Y.

Image forming unit 109M includes photoconductive drum 1M, electrostatic-charging section 2M, developing section 3M and cleaning section 5M.

Image forming unit 109C includes photoconductive drum 1C, electrostatic-charging section 2C, image developing section 3Y and cleaning section 5C.

Image forming unit 109K includes photoconductive drum 1K, electrostatic-charging section 2K, image developing section 3K and cleaning section 5K.

Rotatable photo-conductive drums 1Y, 1M, 1C and 1K are cylindrical members whose surfaces are uniformly charged by a typical electrostatic charging method, such as a Scorotron method. Laser beams are exposed onto the surfaces of photo-conductive drums 1Y, 1M, 1C and 1K via the semiconductor laser devices, whereby the electro-static latent images are formed, based on the outputted intensity of the laser beams.

Charging sections 2Y, 2M, 2C and 2K apply static charges onto the surface of photo-conductive drums 1Y, 1M, 1C and 1K, so as to uniformly charge their surfaces. The development conducted by developing section 3Y, 3M, 3C and 3K, is a reversal development in which the direct current voltage, exhibiting the same voltaic polarity as that of the toner to be used, are superimposed on the alternating current voltage. When the toner is applied, toner images are formed on each surface of photo-conductive drums 1Y, 1M, 1C and 1K.

Cleaning sections 5Y, 5M, 5C and 5K remove any residual toner on photo-conductive drums 1Y, 1M, 1C and 1K.

Semiconductor laser devices 110Y, 110M, 110C and 110K emit the laser beams to scan the surfaces of photo-conductive drums 1Y, 1M, 1C and 1K, while changing the intensity of the laser beams, so that the surfaces of photo-conductive drums 1Y, 1M, 1C and 1K are exposed, whereby the electrostatic latent images are formed. In this case, Semiconductor laser devices 110Y, 110M, 110C and 110K receive driving signals whose intensity are based on each picture element value of the image data, and emit laser beams exhibiting the output intensity based on the picture element value.

Photoconductive drums 1Y, 1M, 1C and 1K are disposed on the exterior surface of endless rotating intermediate transfer belt 111, while on the interior surface of intermediate belt 111, primary transfer rollers 6Y, 6M, 6C and 6K are disposed, facing photoconductive drums 1Y, 1M, 1C and 1K, respectively. Secondary paired transfer rollers 7 sandwich intermediate transfer belt 111, and cleaning section 8 is disposed to remove the toner remaining on the surface of intermediate transfer belt 111.

Since primary transfer bias potential, exhibiting the polarity opposite the using toner, is applied on primary transfer rollers 6Y, 6M, 6C and 6K, the toner images formed on the surfaces of photo-conductive drum 1Y, 1M, 1C and 1K are respectively transferred onto intermediate transfer belt 111 (being the primary image transfer operation), whereby each transferred image is superposed so that resultant color image is formed on the surface of intermediate transfer belt 111.

Intermediate transfer belt 111, carrying the resultant color image, is rotated to secondary paired transfer rollers 7, where the color image is totally transferred onto the surface of sheet media synchronously nipped by secondary paired transfer rollers 7 (being the secondary image transfer operation). After the secondary image transfer operation, cleaning section 8 removes the toner remaining on the surface of intermediate transfer belt 111.

Fixing device heat-presses sheet media so that the color image carried on the surface of sheet media is permanently fixed.

Book binding apparatus 205 incorporates hole-punching section 210 and sheet shifting section 211. Sheet conveyance path 216 is disposed which is from sheet entrance 220 to paired sheet ejection roller 216*f*, passing through hole punching section 210 and sheet shifting section 211. Elevating sheet tray 221 is mounted on the exterior of book binding apparatus 205. Said elevating sheet tray 221 can vertically move.

Sheet conveyance path 216 is formed of plural sets of paired rollers. From sheet entrance 220 to hole punching section 210, paired sheet supplying rollers 216*a* are mounted, which nip sheet media, and rotate to convey sheet media to hole punch section 210.

Paired sheet ejection rollers 216*f*, mounted at the backward position of sheet shifting section 211, eject sheet media onto elevating sheet tray 221.

Hole punching section 210 makes filing holes on sheet media. Shifting section 211 ejects sheet media in such a way that several sheet media as a single group are ejected to one position, and the next group of sheets is ejected to a shifted position.

Control section 102 totally controls image forming apparatus 100 having the above-described structure and book binding apparatus 205, to conduct the image processing control, the setting control of the image formation, the image forming control and the book binding control. In the image processing control, the image signals, outputted from image reading device 100*b*, are changed from the analog signals to the digital signals.

Figure 2:
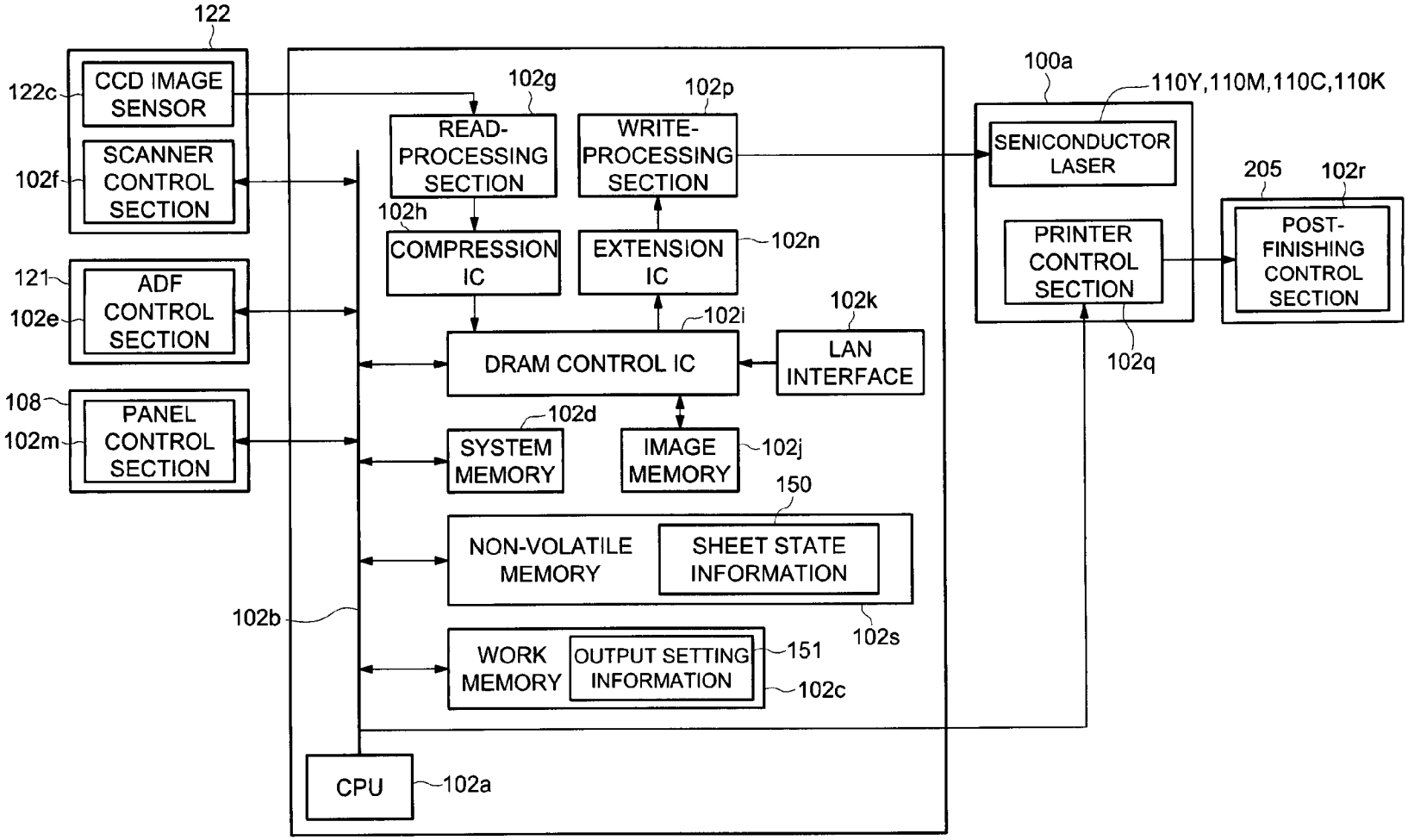
FIG. 2 shows a block diagram of the structure of a control unit provided in the present image forming apparatus.

FIG. 2 shows a block diagram of control unit 102. Control unit 102 is structured of a total control circuit in which CPU 102*a*, work memory 102*c* and system memory 102*d* are included, and a control device which directly controls a processing circuit, a memory circuit, and each section of a driving system. The total control circuit is connected to the memory circuit and the control circuit via bus 102*b*, through which various signals are transmitted. CPU 102*a* totally controls the memory circuit and driving mechanisms.

System memory 102*d*, being a non-volatile memory circuit, memorizes various read-out control programs, which are executed by CPU 102*a*. Work memory 102*c* is a RAM (Random Access Memory), which serves as a working area of CPU 102*a*, on which the programs and the data are developed.

When the image is to be read, CPU 102*a* outputs a control signal to ADF control section 102*e* to drive automatic document feeder 121, and outputs a control signal to scanner control section 102*f* to drive document image scanning exposure device 122. ADF control section 102*e* drives automatic document feeder 121 by sending the control signal. Scanner control section 102*f* drives document image scanning exposure device 122 based on the control signal.

The image data, read by CCD image sensor 122*c* as analog signals, is inputted in reading processing section 102*g*. Reading processing section 102*g* is structured of processing circuits of the images, which converts the image data as the analog signals to an image data as digital signals. After the digital image data is compressed by compressing IC 102*h*, the compressed data is stored in image memory 102*j* by a writing control conducted by DRAM control IC 102*i*.

In a case that this image forming apparatus 100 is used as a copy machine, the output setting of the image is conducted when the output setting is conducted via operation panel 108, when the image on the document is read. In a case that this image forming apparatus 100 is used as a printer, output setting of the image is conducted so as to meet the image data transmission via the terminal on the network. For output setting of the image, various items are selected, such as the size of sheet media used for image forming, a single surface print or double-surface print, the post-finishing is to be conducted or not by book binding apparatus 205, and the type of the post-finishing. CPU 102*a* sets an output state based on a signal which is sent from operation panel 108 through panel control section 102*m*, and memorizes the output type in work memory 102*c* as output setting information.

CPU 102*a* controls the image data for each printing job, and totally controls so that the printing jobs are executed in a sequential order. CPU 102*a* instructs read-out of the image data corresponding to the executing jobs, to DRAM control IC 102*i*. Further, CPU 102*a* instructs the rotation of the image at 90°, −90°, or 180°. The image is rotated based on the binding direction inputted via operation panel 108.

DRAM control IC 102*i* reads out the image data from image memory 102*j*, based on a read-out instruction and an image rotation instruction from CPU 102*a*. If the image rotation is instructed, DRAM control IC 102*i* reads out and rotates the image data so as to meet the instructed rotation direction. The image data, read out by DRAM control IC 102*i*, is expanded by expanding IC 102*n*, after which the expanded image data is outputted to writing process section 102*p*.

Still further, CPU 102*a* outputs a starting signal which instructs starting of the image formation to printer control section 102*q*.

When the image data enters writing process section 102*p*, writing process section 102*p* outputs driving signals, exhibiting the intensity based on the image element value of each color of the image data, to semiconductor laser devices 110Y, 110M, 110C and 110K, and simultaneously controls scanning of laser beams.

While synchronizing to the control conducted by writing control section 102*p*, onto semiconductor laser devices 110Y, 110M, 110C and 110K, printer control section 102*q* sends the driving signals to sheet medias storing section 103, conveyance path 105, image output section 104, and fixing device 106, so that the image is formed on sheet media.

Among plural sheet medias storing sections 103, a sheet medias storing section to deliver sheet media is selected based on output setting information 151, while referring to sheet state information 150 previously stored in non-volatile memory 102*s*. The types of sheet medias, stored in each sheet medias storing section 103, are registered in said sheet state information 150. That is, sheet state information 150 includes the sheet size, the sheet weight, the sheet color, the sheet storing direction, such as a lengthwise direction or a widthwise direction, and the sheet carrying punched holes or not, for each sheet medias storing sections. These sheet states are previously inputted via operation panel 108 inputted. CPU 102*a* sets the sheet states based on the signals, outputted from operation panel 108, through panel control section 102*m*, and memorizes the sheet states as sheet state information 150 into non-volatile memory 102*s*.

During the image formation, when the image formation for a single sheet is completed, printer control section 102*q* outputs a completion checking signal to CPU 102*a*. CPU 102*a* checks the number of sheets carrying the image data, the number of outputted sheet groups, and post-finishing operation to be conducted or not. If the image formation is conducted until a break point of a group, and if the post-finishing operation is instructed, CPU 102*a* outputs a starting signal to instruct starting of the post-finishing operation to post-finishing control section 102*r*.

Post-finishing control section 102*r* sends a driving signal to hole punch section 210 or sheet shifting section 211, to punch the holes onto the bundle of sheet media outputted from image forming apparatus 100, and to eject it onto a predetermined ejection position.

When sheet state information 150 is to be stored in non-volatile memory 102*s*, and output setting information 151 is to be stored in work memory 102*c*, via operation panel 108, CPU 102*a* displays an interactive screen for registering the sheet state, and an interactive screen for the output setting, on operation panel 108. When the operator presses a button to change the registration of the sheet state, or presses a button to change the output setting, the signals corresponding to the pressed buttons are inputted to CPU 102*a*. CPU 102*a* outputs illustrating data to panel control section 102*m*, where the illustrating data is used for illustrating interactive screens for the registration of sheet state and the output setting, so that the corresponding interactive screens are displayed on operation panel 108. When the output setting is conducted via the terminal on the network, CPU 102*a* outputs signals for retrieving an interactive screen for the output setting, to the terminal via the network.

While interactive screens, corresponding to the operation on operation panel 108 indicated by the interactive screen, are scrolled down, sheet state information 150 is stored in non-volatile memory 102*s*, and output setting information is stored in work memory 102*c*.

Based on sheet state information 150 and output setting information 151, CPU 102*a* outputs the instructions, such as reduction or enlargement of the image, to DRAM control IC 102*i*, and CPU 102*a* further outputs the control signals to printer control section 102*q*, in which sheet media storing section 103 is shown from which sheet media is to be picked up, and in which the instructions are shown concerning the double-surface printing or the single surface printing.

While referring to these interactive screens, the process flows of the registration of sheet state information 150 and the alteration of output setting information 151, both conducted by CPU 102*a*, will be detailed based on FIG. 3 to FIG. 13.

FIGS. 3-7 show scrollable interactive screens to register sheet state information 150, and in particular, show the scrollable interactive screens to register the sheets carrying punched holes.

Figure 8:
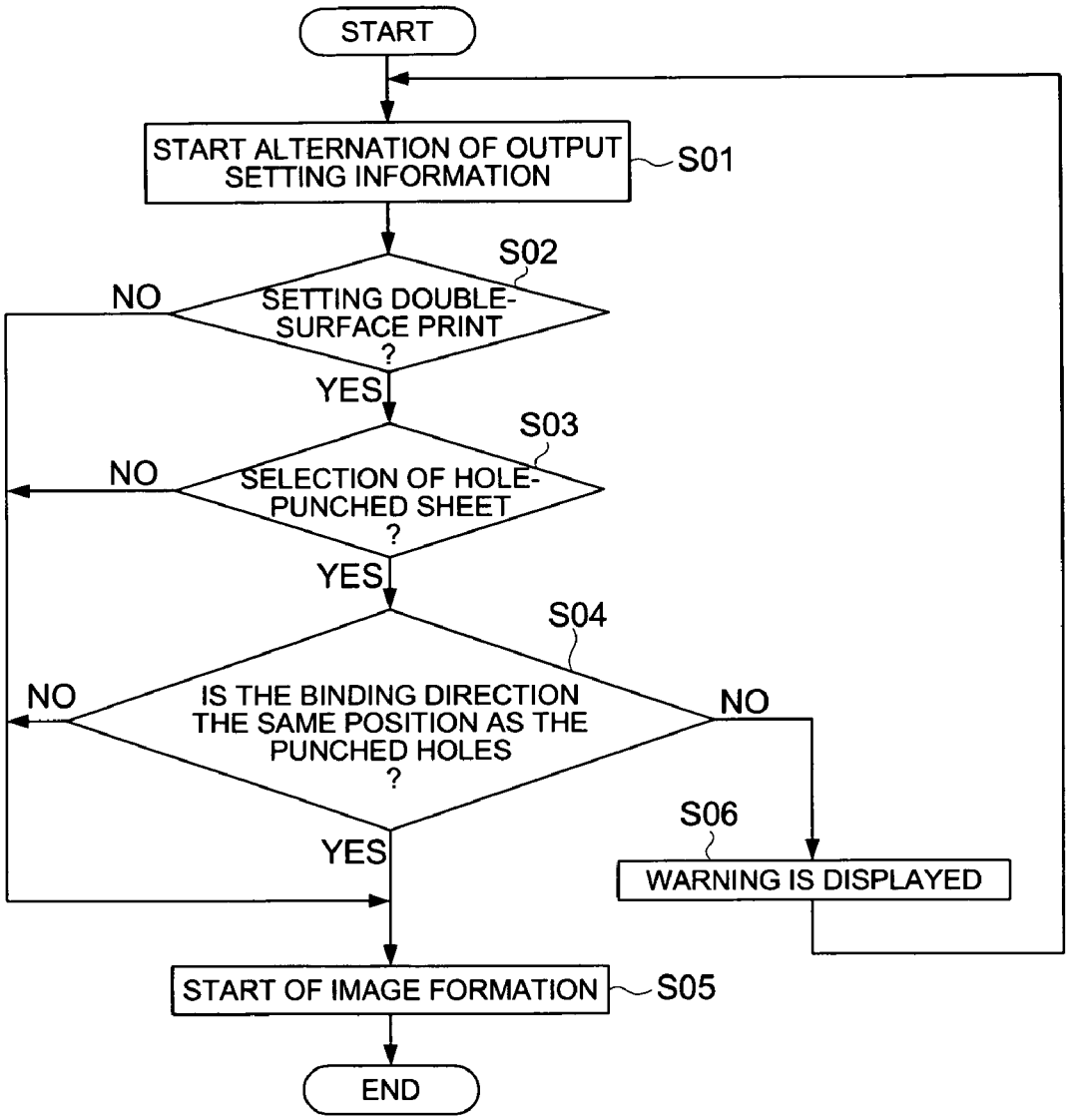
FIG. 8 is a flow chart to show the process from changing output setting information to starting image formation, relating to the first embodiment.
Figure 9:
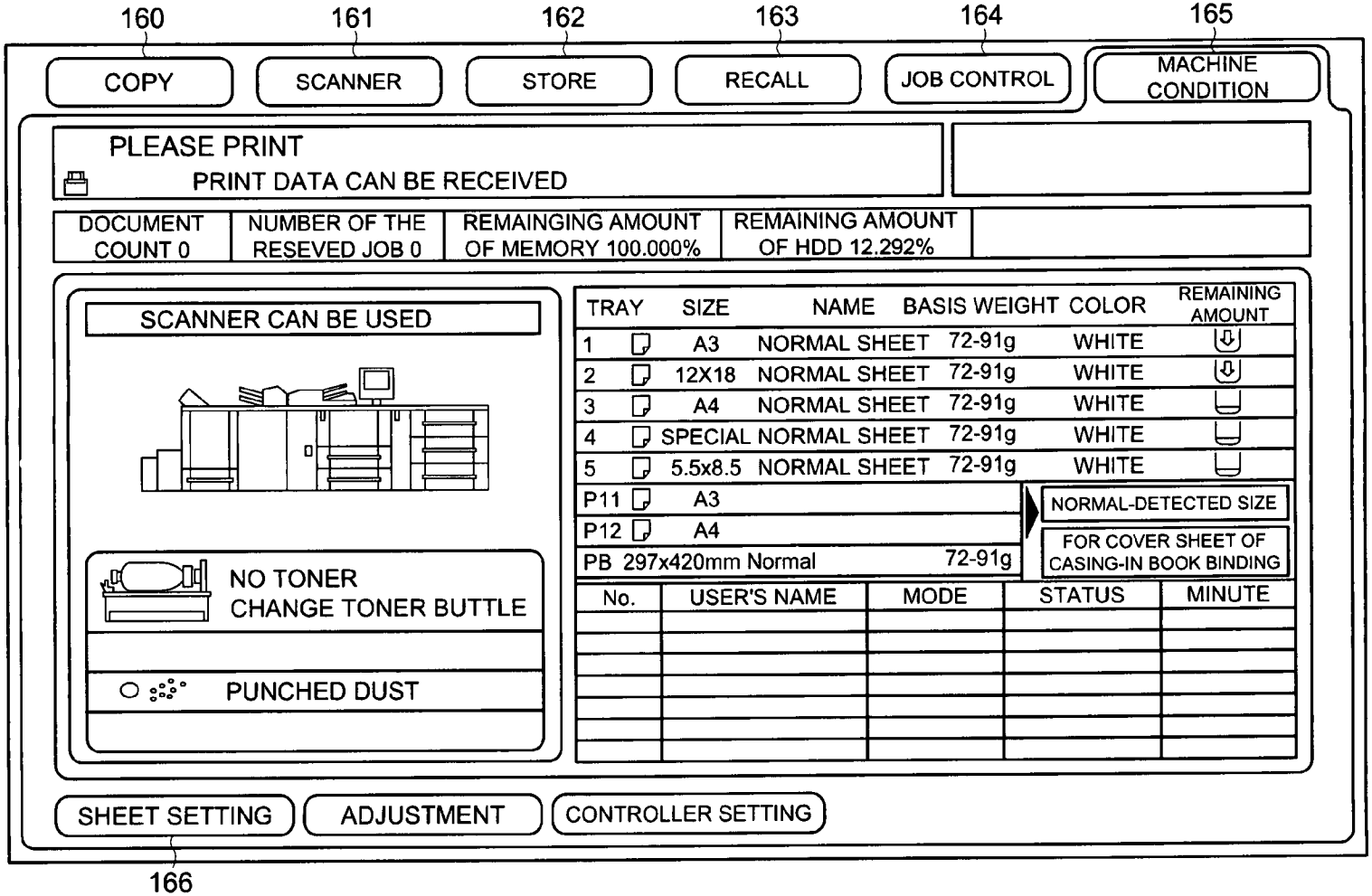
FIG. 9 shows a first scrollable interactive screen to set double-surface binding on a hole-punched sheet.
Figure 10:
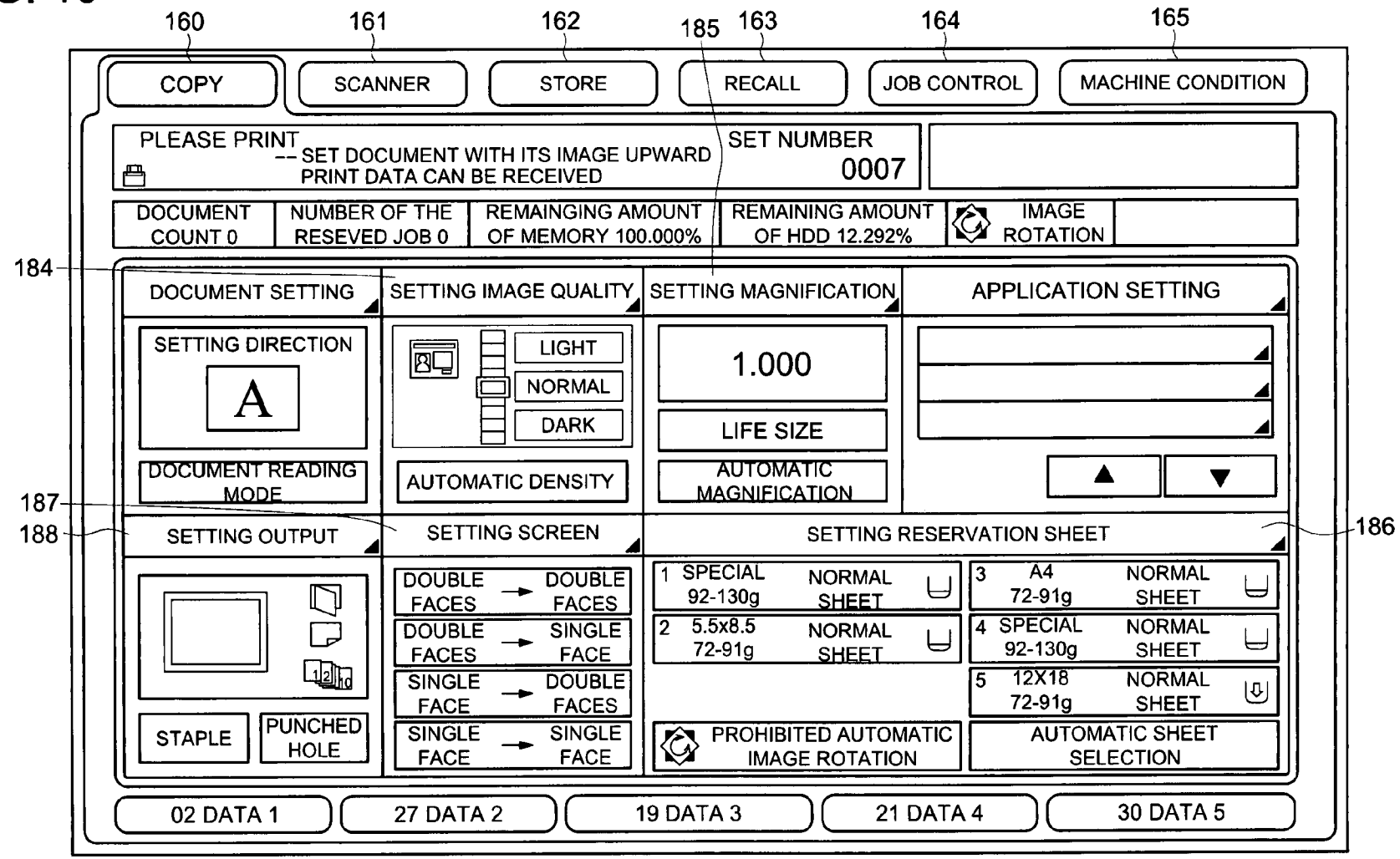
FIG. 10 shows a second scrollable interactive screen to set double-surface binding on a hole-punched sheet.
Figure 11:
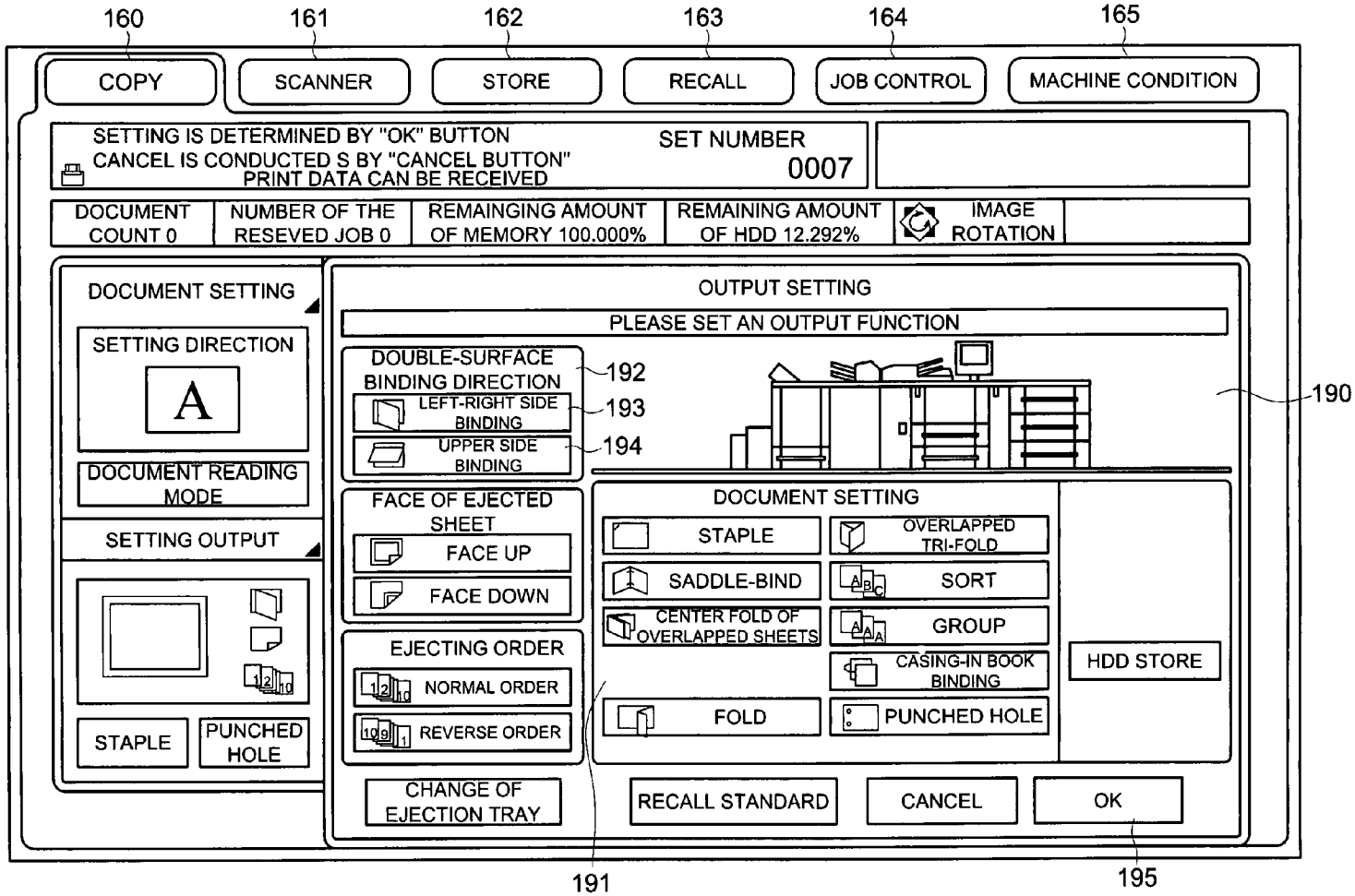
FIG. 11 shows a third scrollable interactive screen to set double-surface binding on a hole-punched sheet.

FIG. 8 is a flow chart to show the process from changing output setting information conducted by CPU 102*a* to starting image formation. FIGS. 9-11 show the scrolled interactive screens to change output setting information 151, and in particular, to set the double-surface-binding onto the sheet carrying punched holes.

FIG. 12 is the equality determining table to show the alteration of allowable output setting information and the alteration of prohibited output setting information, based on sheet state information.

Figure 13:
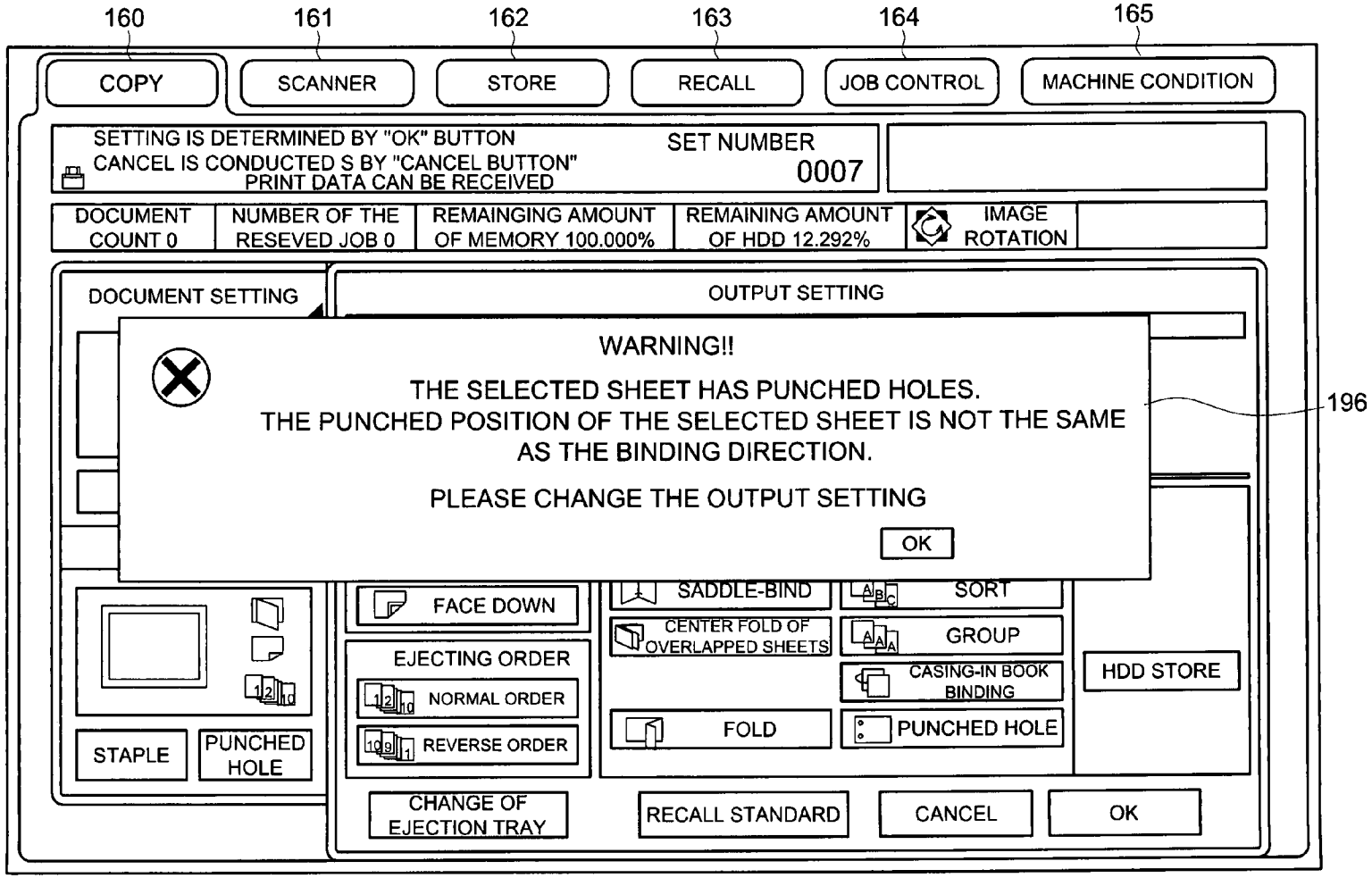
FIG. 13 shows an warning screen which is displayed when prohibited output setting information is inputted.

FIG. 13 shows the warning screen which is displayed when the prohibited output setting is inputted.

Figure 3:
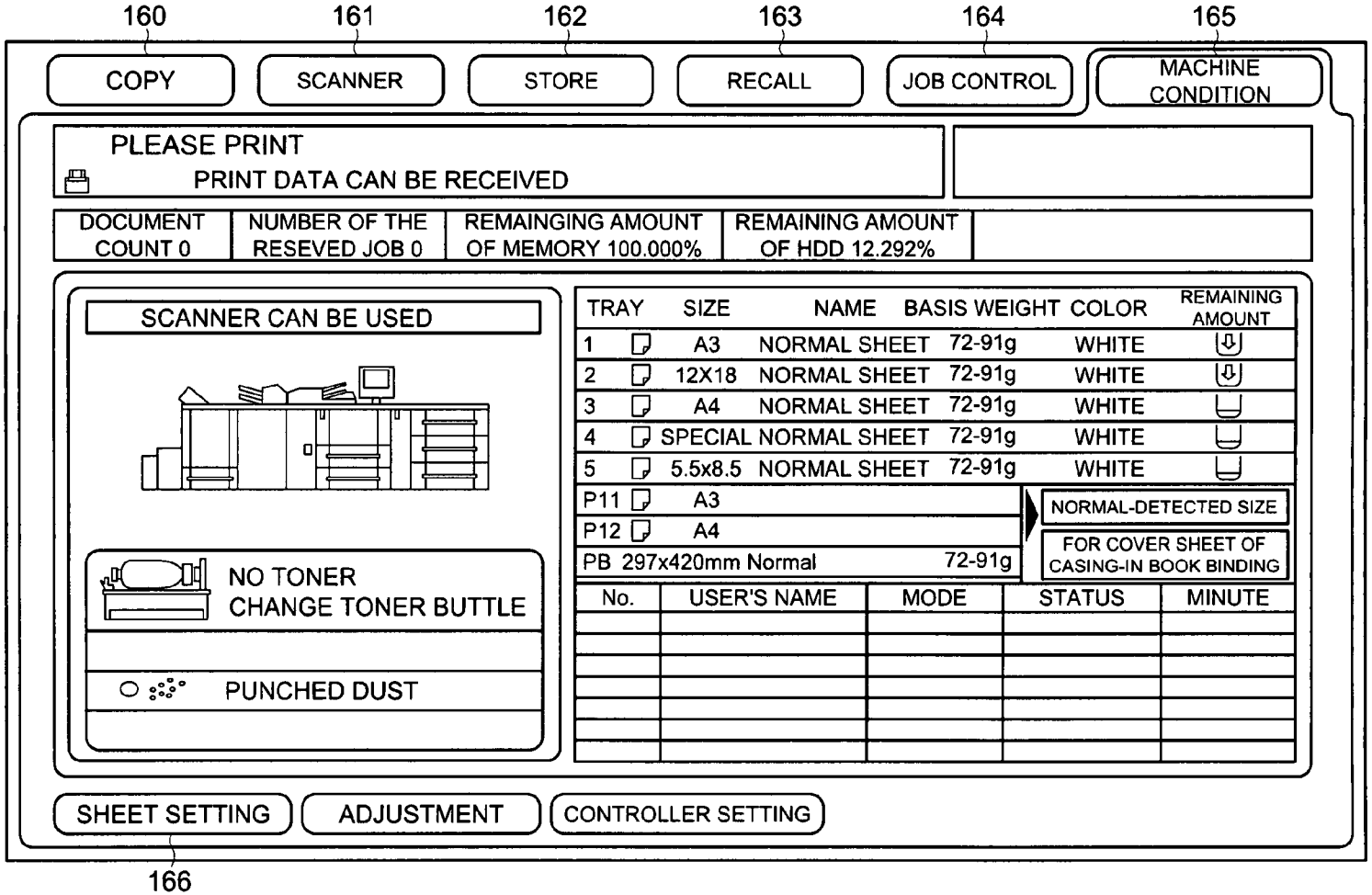
FIG. 3 shows a first scrollable interactive screen to register a hole-punched sheet.

As shown in FIG. 3, various tabs are provided to select various panel screens, on the upper section of the screen displayed on operation panel 108. The displayed tabs are copy setting tab 160, scanner setting tab 161, storage setting tab 162, read-out setting tab 163, job control tab 164, and machine condition display tab 165.

Copy setting tab 160 displays existing output setting information 151 for copy, and switches to a panel screen on which the alternation of said output setting information 151 can be inputted.

Scanner setting tab 161 displays existing setting for image scan, and switches to a panel screen on which the alternation of said setting can be inputted.

Storage setting tab 162 displays the stored image data, and switches to a panel screen on which the instruction can be inputted, such as the deletion of said image data.

Read-out setting tab 163 displays the stored image data, and switches to a panel screen on which an image data to be outputted can be instructed.

Job control tab 164 displays the list of the controlled jobs, and switches to a panel screen on which the order of the jobs can be changed and a job can be cleared.

Machine condition display tab 165 displays the machine conditions of image forming apparatus 100 and book-binding apparatus 205, as well as sheet state information 150, and switches to a panel screen on which adjustment of both image forming apparatus 100 and book-binding apparatus 205, setting of a controller and the alternation of registration of sheet state information 150 can be inputted.

For conducting the display and alternation of sheet state information 150, the operator presses down machine condition display tab 165 on operation panel 108. CPU 102*a* then displays the machine conditions, such as an amount of remaining toner and an amount of hole-punched scraps, on the panel screen, as well as the state of sheet stored in each sheet media storing section 103, as sheet state information 150. At the lower section of the panel screen corresponding to machine condition display tab 165, sheet setting button 166 is displayed to change sheet state information 150.

Figure 4:
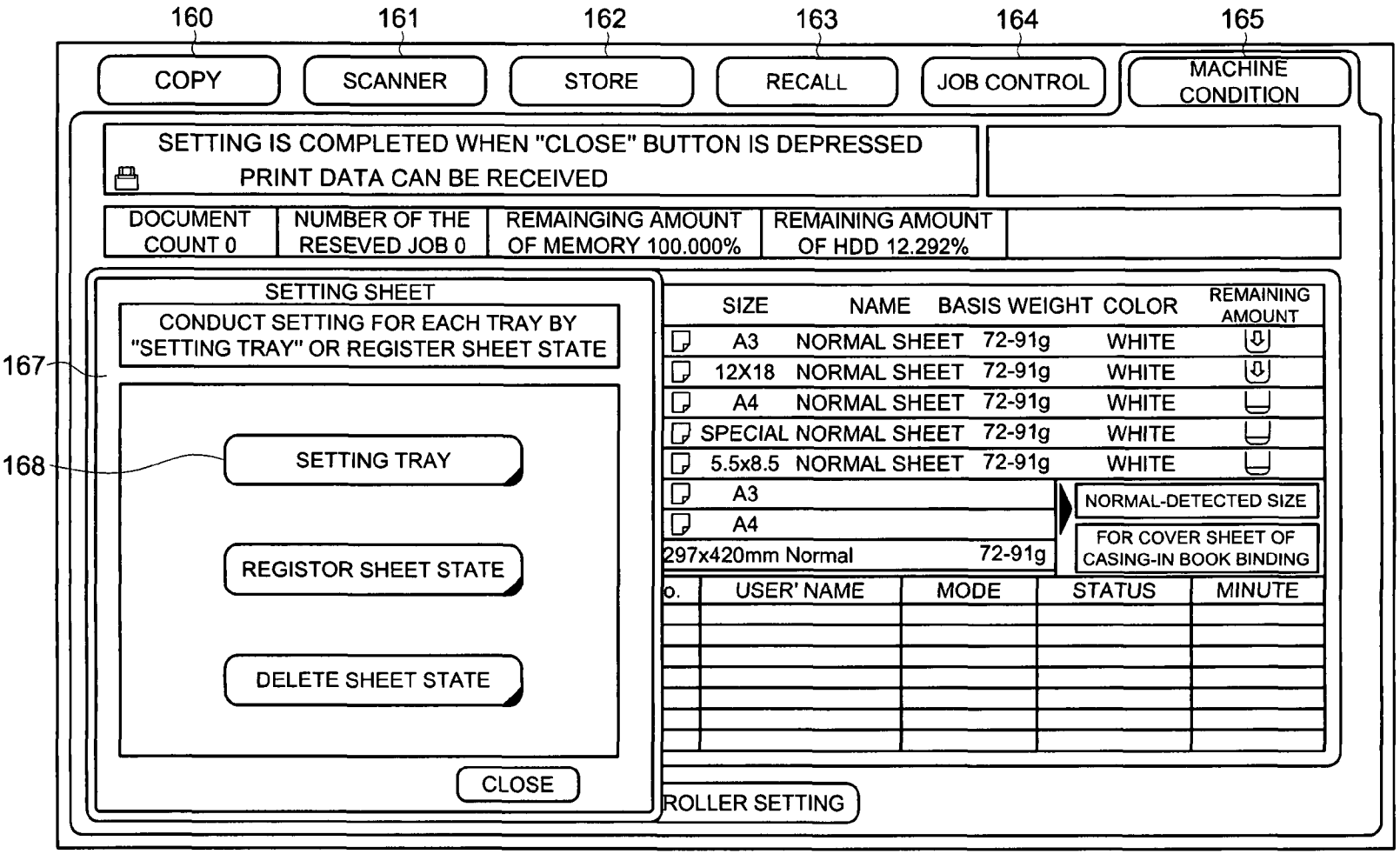
FIG. 4 shows a second scrollable interactive screen to register a hole-punched sheet.

When sheet setting button 166 is pressed, sheet setting pop-up window 167 is displayed on the panel screen, to change sheet state information 150, as shown in FIG. 4. On sheet setting pop-up window 167, tray setting button 168 is displayed to scroll to a pop-up window, through which the states of sheet media in each sheet media storing section 103 are set and registered.

Figure 5:
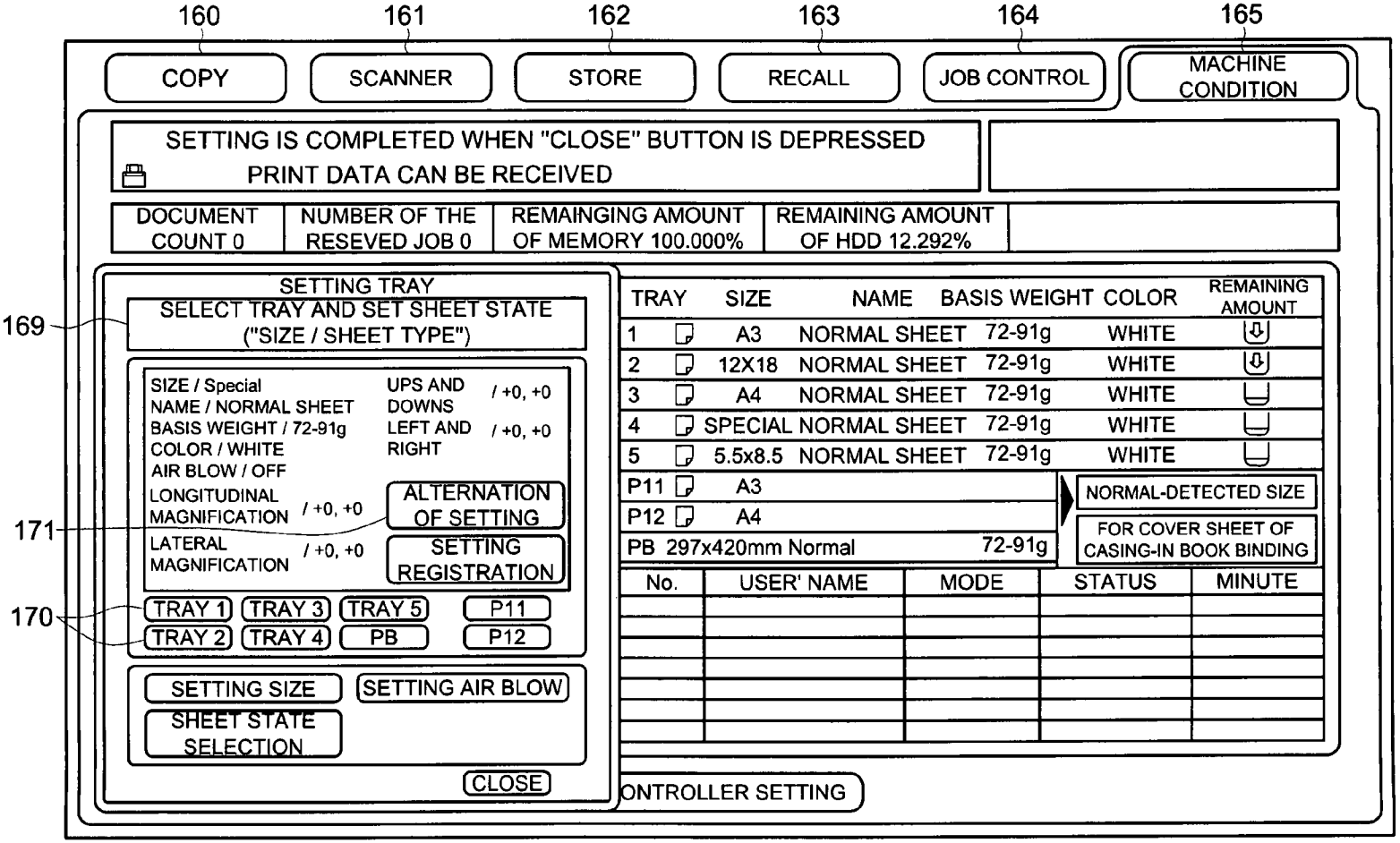
FIG. 5 shows a third scrollable interactive screen to register a hole-punched sheet.

When tray setting button 168 is pressed, the pop-up window changes to tray setting pop-up window 169, as shown in FIG. 5. On tray setting pop-up window 169, sheet state information 150 to be changed is displayed with regard to the tray number of sheet media storing section 103, and further, it is possible to scroll to a screen on which said displayed sheet state information 150 is changed.

In order to select any one of sheet media storing sections 103, tray setting buttons 170, prepared for each tray number, are displayed on tray setting pop-up window 169. When any one of tray setting buttons 170 is depressed, previously registered sheet state information 150 is displayed on tray setting pop-up window 169, which is for sheet media stored in sheet media storing section 103 corresponding to depressed button 170. For example, tray setting button 170 corresponding to tray number "4" is depressed, previously registered sheet state information 150 is displayed, which is for sheet media stored in sheet media storing section 103 identified by tray number 4.

Further, setting change button 171 for changing sheet state information 150, as well as sheet state information 150, is displayed on tray setting pop-up window 169. Setting change button 171 works for changing displayed sheet state information 150 to a desired screen.

Figure 6:
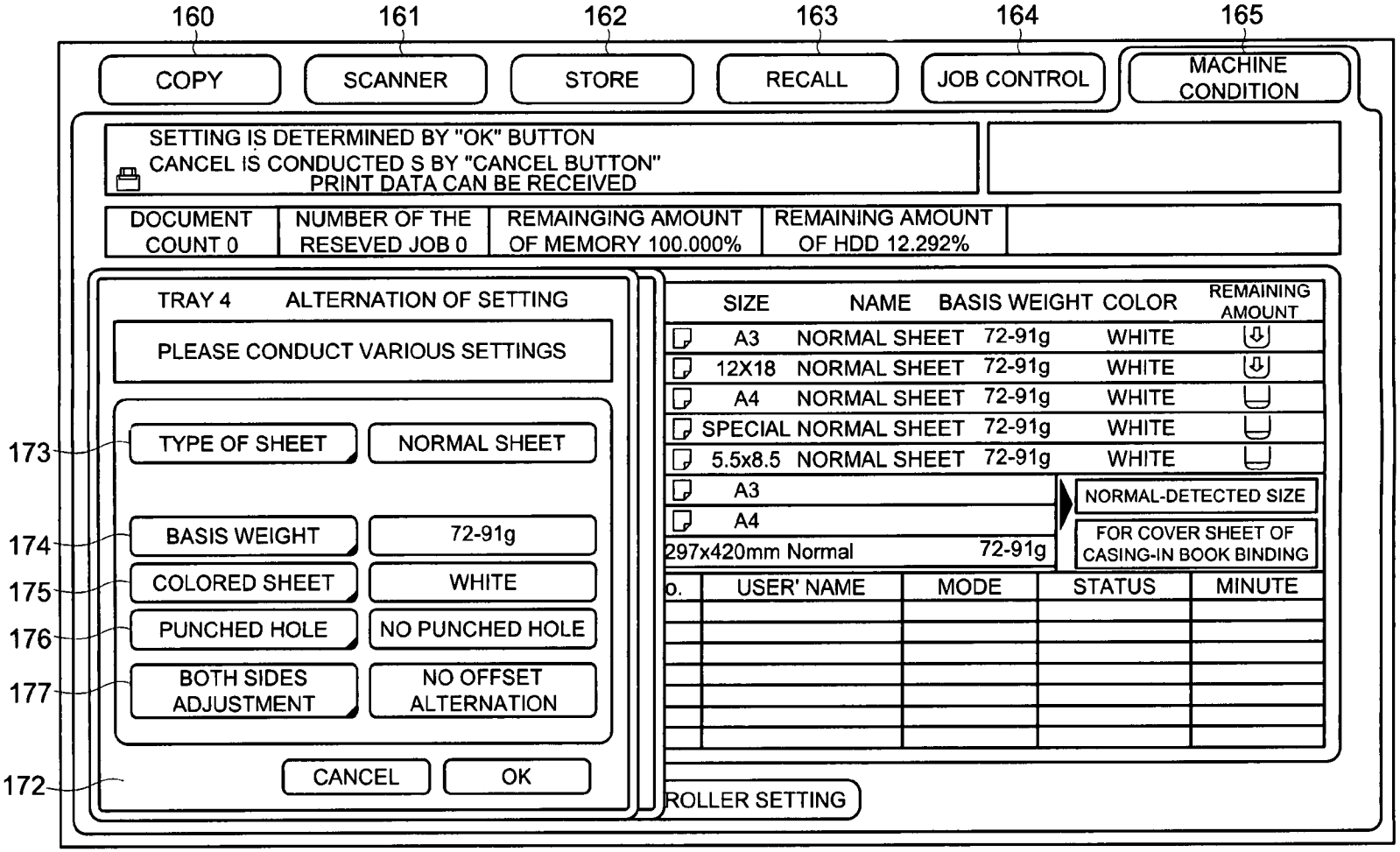
FIG. 6 shows a fourth scrollable interactive screen to register a hole-punched sheet.

When setting change button 171 is depressed, setting selection pop-up window 172 is switched to tray setting pop-up window 169, and is displayed as shown in FIG. 6. For example, tray button 170, corresponding to tray number "4", is depressed, after which setting change button 171 is depressed, then setting selection pop-up window 172 is displayed, which concerns sheet media stored in sheet media storing section 103 corresponding to tray number "4".

Setting selection pop-up window 172 is a pop-up window to change the practical contents of sheet state information 150. Sheet type selection button 173, basis weight input button 174, color-sheet selection button 175, punch hole button 176, and double surfaces adjusting button 177 are displayed in said setting selection pop-up window 172. Additionally, a previously existed setting condition is displayed while aligning to each button.

Sheet type selection button 173 is a button for selecting a type of sheet, such as light weight coated sheet, art sheet, and normal sheet.

Basis weight input button 174 is a button for displaying a field where the basis weight of sheet media is inputted.

Color-sheet selection button 175 is a button for selecting a color of sheet media.

Punch hole button 176 is a button for selecting existence of the punched holes and a position of the punched holes.

Double surfaces adjusting button 177 is button for displaying a field to adjust an offset of the double surfaces of sheet media.

Figure 7:
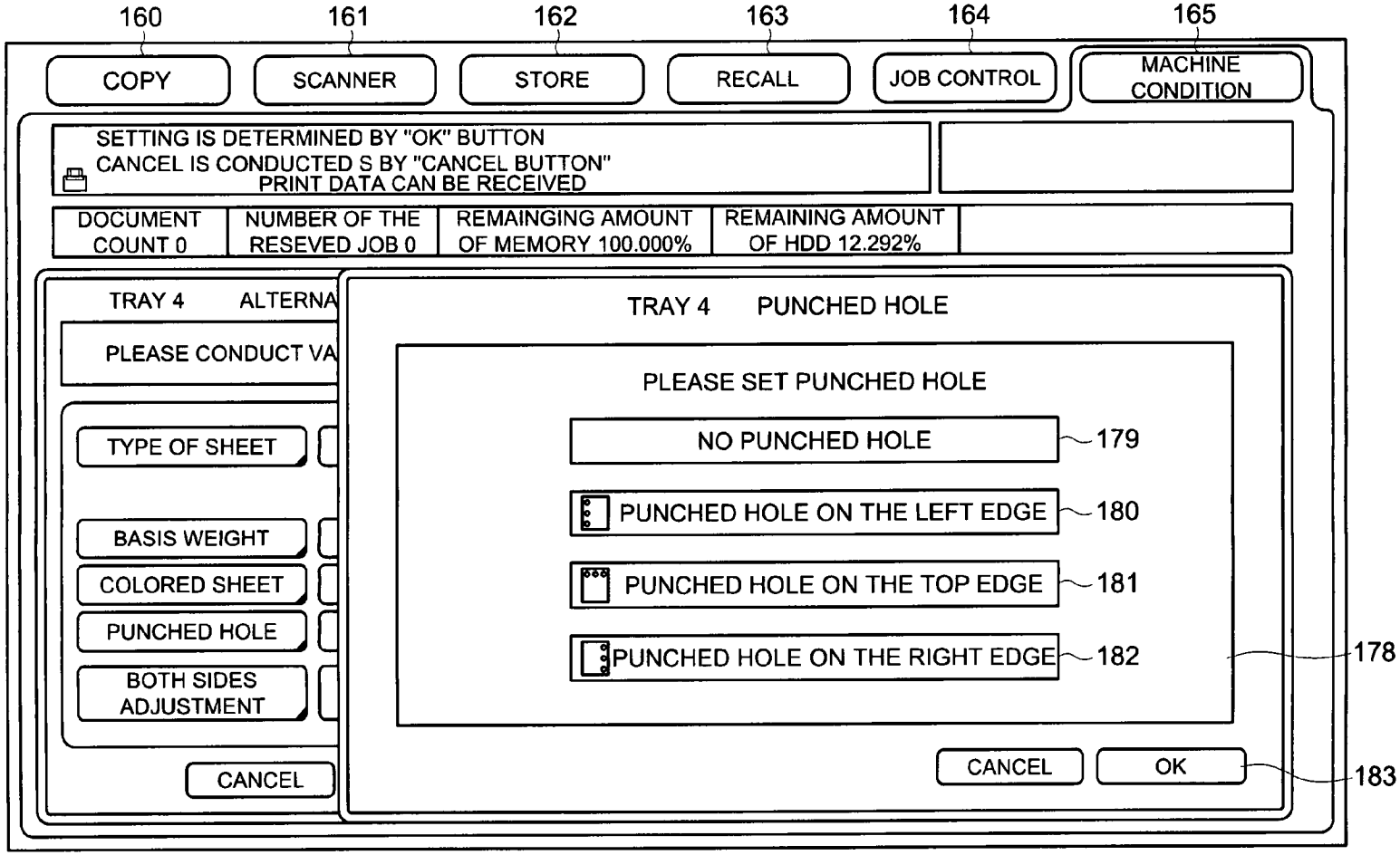
FIG. 7 shows a fifth scrollable interactive screen to register a hole-punched sheet.

When punch hole button 176 is depressed, punch hole setting pop-up window 178 is further displayed as shown in FIG. 7. Punch hole setting pop-up window 178 is a pop-up window to select whether the holes are previously punched or not, and to select a punched position, on sheet media stored in sheet media storing section 103 whose sheet state information 150 is to be changed.

Non punch hole button 179, left punch hole button 180, top punch hole button 181 and right punch hole button 182 are displayed on said punch hole setting pop-up window 178. In addition, a button to register punch holes at a bottom position on sheet media may be displayed. "Top, bottom, left and right" each means that one direction of a sheet media is determined to be upward. Further, various buttons may be displayed, such as a button to register that the holes are punched at a position where the holes are on the shorter edge to be bound, or a button to register that the holes are punched at a position where the holes are on the longer edge to be bound. A case that the holes are punched at the longer edge of sheet media means that the holes are punched at a position for the longer edge binding. A case that the holes are punched at the shorter edge of sheet media means that the holes are punched at a position for the shorter edge binding.

After non punch hole button 179 is depressed, OK button 183 is depressed, whereby CPU 102*a* updates an item concerning the hole punch of sheet state information 150 to a non-hole punch state in non-volatile memory 102*s*.

After left punch hole button 180 is depressed, OK button 183 is depressed, whereby CPU 102*a* updates an item concerning the hole punch of sheet state information 150 to information exhibiting that the holes have been punched on the left edge of the sheet, in non-volatile memory 102*s*.

After top punch hole button 181 is depressed, OK button 183 is depressed, whereby CPU 102*a* updates an item concerning the hole punch of sheet state information 150 to information exhibiting that the holes have been punched on the top edge of the sheet, in non-volatile memory 102*s*.

After right punch hole button 182 is depressed, OK button 183 is depressed, whereby CPU 102*a* updates an item concerning the hole punch of sheet state information 150 to information exhibiting that the holes have been punched on the right edge of the sheet, in non-volatile memory 102*s*.

For example, based on the interactive screens shown in FIGS. 3-7, the operator changes sheet state information 150 of sheet media storing section 103 corresponding to tray number "4", and re-registers that the holes have been punched on the left, whereby sheet state information 150 exhibiting said re-registration is stored in non-volatile memory 102*s*.

From now, under the above condition, the process from the alternation of output setting information 151 to the start of image formation, conducted by CPU 102*a*, will be detailed based on FIGS. 8-13.

As shown in FIG. 8, when a mode is operated to change the output setting of the images, CPU 102*a* starts changing output setting information 151 (step S01). Subsequently, CPU 102*a* determines whether sheet state information 150 is the same as output setting information 151 to be changed, and if they are the same to each other, CPU 102*a* starts the image formation, and if they are not the same to each other, CPU 102*a* starts an alert warning.

Initially, when copy tab 160 is depressed on the interactive screen shown in FIG. 9, the screen changes to a panel screen for changing the various output setting of the copy operation. Said panel screen for changing the various output setting of the copy operation displays;

image quality setting field 184 for setting the image quality, magnification setting field 185 for selecting a magnification of the image to be formed on sheet media, reservation setting field 186 for selecting a sheet media on which the image is to be formed, double surfaces setting field 187 for setting whether the image is to be formed on the both surfaces, and output setting button 188 for changing other output settings.

On image quality setting field 184, an image density can be selected among original density read from the image, density lower than the original density, and density higher than the original density. CPU 102*a* changes the value of image elements so that the output intensities of semiconductor laser 110Y, 110 M, 110C and 110K are changed.

On magnification setting field 185, various magnifications can be entered. CPU 102*a* changes the image data to the inputted magnification.

On reservation setting field 186, buttons are displayed which display the sheet size, the sheet type, and the basis weight, for each sheet media storing section 103. Sheet media storing section 103 from which sheet media are picked up in this case is determined after any one of each button are depressed. CPU 102*a* outputs a control signal so as to pick up sheet media from determined sheet media storing section 103.

On double surfaces setting field 187, buttons for selecting a single surface printing or a double-surface printing are displayed. When a button for printing the images of the double surfaces of a single document sheet to the double surfaces of a single sheet media (hereinafter referred to as "D-D button") is selected, CPU 102*a* totally controls document reading apparatus 100*b* and printer control section 102*q* to read the images from the double surfaces of the document sheet and form the images on the double surfaces of sheet media. Further arranged are a button for reading the image from the double surfaces and forming the image on the single surface of two sheet media (hereinafter referred to as "D-S button"), a button for reading the image from each single surface of two sheet medias and forming the image on the double surfaces of a single sheet media (hereinafter referred to as "S-D button"), and a button for reading the image from a single surface and forming the image on a single surface (hereinafter referred to as "S-S button").

When output setting button 188 is depressed, an interactive screen is scrolled to conduct various output settings other than the above settings.

When the alternation of output setting information 151 starts, CPU 102*a* determines on double surfaces setting field 187 whether the output setting to form the image on the double surfaces has been conducted (S02). After either D-S button or S-S button is depressed, the printing operation onto the single surface of sheet media is selected (No in step S02), whereby since sheet state information 150 is the same as output setting information 151, CPU 102*a* starts reading the image to form the image (S05), and the equality determining process is completed.

After either D-D button or S-D button is depressed and the output setting is conducted to form the image on the both surfaces of the sheet media (Yes in S02), CPU 102*a* determines whether the sheet media carrying punched holes is selected on sheet reservation setting field 186 (S03). In a case that the sheet media carrying punched holes has been stored in tray 4, depression of a button corresponding to tray 4 means that the sheet media carrying punched holes is selected.

From non-volatile memory 102*s*, CPU 102*a* reads out sheet state information 150 corresponding to the tray number depressed on sheet reservation setting field 186, if information of no punched holes is included in said information, CPU 102*a* determines that sheet media having no punched holes is selected. If information of holes punched on the top edge or left or right edge is included in said information, CPU 102*a* determines that sheet media having punched holes is selected.

If the sheet media carrying punched holes is not selected (No in S03), sheet state information 150 is the same as output setting information 151, that is, CPU 102*a* reads out the images and starts image formation (S05), by which equality determining process is completed.

If the sheet media carrying punched holes is selected (Yes in S03), CPU 102*a* determines whether the binding of the printed matters is on the same edge as the punched holes (S04).

When output setting button 188 is depressed, as shown in FIG. 11, output setting pop-up window 190 is displayed to conduct other on various output settings. Various fields are displayed in output setting pop-up window 190, including post-finishing field 191 to select contents of the post-finishing operation and double-surface binding direction field 192 to select the binding direction in the case of double-surface print.

On post-finishing field 191, various processes can be selected, such as stapling process, saddle binding, center folding, letter folding, folding, sorting, grouping, casing-in book binding, and hole punching, all of which are conducted in book-binding apparatus 205.

On double-surface binding direction field 192, left right binding button 193 to select left or right binding, and top binding button 194 to select the top binding are displayed.

While referring to the equality determining table, CPU 102*a* determines whether the binding, corresponding to the button depressed on double-surface binding direction field 192, is on the same edge as the punched holes on the sheet media, which is selected on sheet reservation setting field 186. The equality determining table has been stored in system memory 102*d* as a portion of the control program, which is read out when the judgment on step S04 is conducted, and is then developed on work memory 102*c*.

On the equality determining table in FIG. 12, the type of document, the type of sheet media onto which the image is outputted, the position of the punched holes of the sheet media onto which the image is outputted, and the binding direction are coordinated, whereby the equality determining table shows whether the position of the punched holes is the same as the binding direction for each case. In this case, the binding direction is determined to be top, bottom, left or right edge based on a document to be read. That is, concerning the top edge binding, its binding direction is set so that the top edge of the document to be read is bound.

The type of the documents is divided into a portrait type and a landscape type, and the type of the sheet media onto which the image is to be outputted is divided into LEF (being Long Edge Feed) transfer sheet and SEF (being Short Edge Feed) transfer sheet. The document of the portrait type and the LEF transfer sheet are conveyed while leading their long edge, while the document of the landscape type and the SEF transfer sheet are conveyed while leading their short edge. For reading the portrait document and forming the image on the SEF transfer sheet, as well as for reading the landscape document and forming the image on the LEF transfer sheet, it is assumed that the image is processed with +90° rotation or −90° rotation. That is, the LEF transfer sheet is conveyed in conveyance route 105 while its long edge is led, and the SEF transfer sheet is conveyed in conveyance route 105 while its short edge is led.

For example, in a case of reading the portrait document and forming the image on the LEF transfer sheet carrying punched holes on its left or right edge (that is, carrying punched holes on the long edge), if the binding direction, determined on double-surface binding direction field 192, is the left or right binding (being the long edge binding), the position of the punched holes is the same as the binding direction, whereby "OK" is described to show equality in "combination" column 189 concerning the above combination. On the other hand, if the double-surface binding direction, determined on double-surface binding direction field 192, is the top edge binding (being the short edge binding) though binding on the left or right edge is previously determined, the position of the punched holes is not the same as the binding direction, whereby "NG" is described to show mismatch in "combination" column 189 concerning the above combination.

In the same way, for example, in a case of reading the landscape document and forming the image on the LEF transfer sheet carrying punched holes on its left or right edge (that is, carrying punched holes on the long edge), if the binding direction, determined on double-surface binding direction field 192, is the top edge binding (being the long edge binding, because the image is rotated +90° or −90° on the LEF transfer sheet), the position of the punched holes is the same as the binding direction, whereby "OK" is described to show equality in "combination" column 189 concerning the above combination. On the other hand, if the double-surface binding direction, determined on double-surface binding direction field 192, is the left or right edge binding (being the short edge binding, because the image is rotated +90° or −90° on the LEF transfer sheet), the position of the punched holes is not the same as the binding direction, whereby "NG" is described to show the mismatch in "combination" column 189 concerning the above combination.

While referring to the equality determining table, CPU 102*a* determines whether combination column 189, described in a column corresponding to the relationship between the binding direction and the position of the punched holes, shows "OK" or "NG".

After the above determination, if the binding direction is the same as the position of punched holes (Yes in S04), CPU 102*a* reads out the image to start image formation (S05), and the equality determining process is completed. On the other hand, if the binding direction is not the same as the position of punched holes (No in S04), CPU 102*a* allows operation panel 108 to display warning to show the mismatch via panel control section 102*m* (S06), and CPU 102*a* does not start image formation but changes the screen to the initial screen to conduct re-setting, and returns the step to step S01.

In addition, a control to start image formation in the present invention means at least a control to print the image on the sheet. In the present embodiment, In the case that the binding direction is not the same as the punched hole position, starting control of reading the document images as well as starting control of image formation is suspended, when the system is operated as the image copier. Further when the system is operated as the printer, the image data can be received, but starting control of image formation based on the received image data is suspended.

On the interactive screen shown in FIG. 11, after OK button 195 is depressed to determine other settings, CPU 102*a* conducts determination of S02-S04, and if the binding direction is not the same as the punched hole position, warning pop-up window 196 is displayed as shown in FIG. 13. On warning pop-up window 196, displayed are that the selected sheet has punched holes, the binding direction is not the same as the hole punched edge, and that output setting is requested. After OK button is displayed, CPU 102*a* returns the display screen to the interactive screen shown in FIG. 10.

As described above, in image forming apparatus 100 of the present embodiment, in the case that image formation is conducted on the sheet media carrying punched holes, if binding direction of a booklet to be outputted is not the same as the position of the punched holes, the starting control of image formation is interrupted. That is, CPU 102*a* interrupts the starting control, and again requires the output setting. By this procedure, the output setting is perfectly conducted having the sameness between the punched hole position and the binding direction, accordingly, book binding using the punched holes or a booklet bound by the punched holes can be produced.

The Second Embodiment

Next, image forming apparatus 100 relating to the second embodiment is detailed which prevents non-equality between the punched hole position and the binding direction. In image forming apparatus 100 relating to the second embodiment, when the punched hole position is not the same as the binding direction, preference is given to the punched hole position, that is, the image is rotated to make the binding direction to be the same as the punched hole position.

Figure 14:
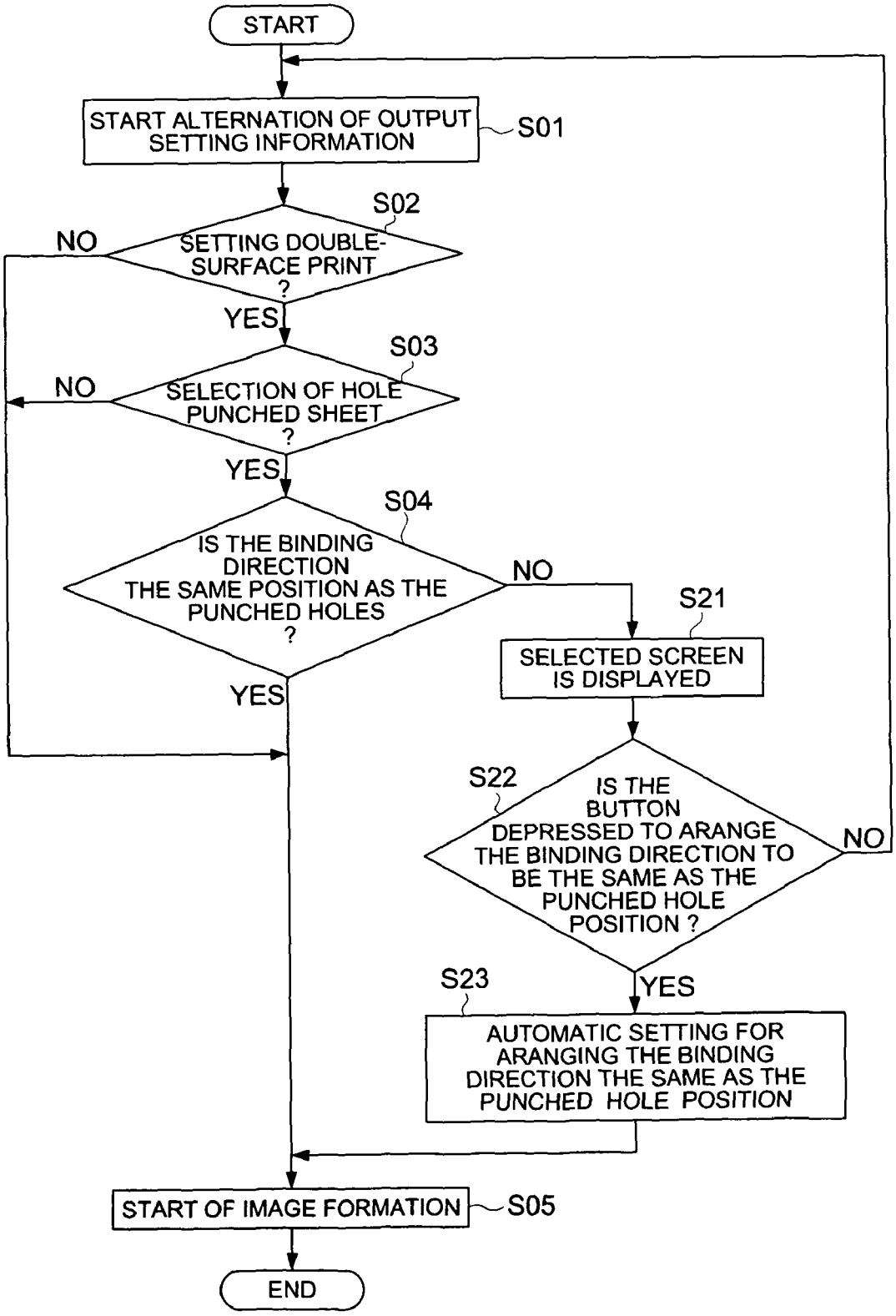
FIG. 14 is a flow chart showing the process from changing output setting information to starting of image formation, relating to a second embodiment.

FIG. 14 is a flow chart which shows the steps from the alternation of output setting information 151 to the start of image formation conducted by CPU 102*a* of the second embodiment. Since the alternation of sheet state information 150, the process of S01-S04 in FIG. 8 and the displayed screens of the first embodiment, are used in the same ways in the second embodiment, their explanation in the second embodiment is not detailed.

As shown in FIG. 14, the double-surface print is selected (Yes in S02), and the selected sheet media has the punched holes (Yes in S03), after which CPU 120*a* determines whether the binding direction of the printed matters is on the same as the punched hole position (S04). If the binding direction of the printed matters is on the same as the punched hole position (Yes in S04), CPU 102*a* reads the image to start image formation (S05), whereby the equality determining process is completed.

If the binding direction of the printed matters is not on the same as the punched hole position (No in S04), CPU 102*a* allows operation panel 108 to display a selection screen via panel control section 102*m* (S21).

Figure 15:
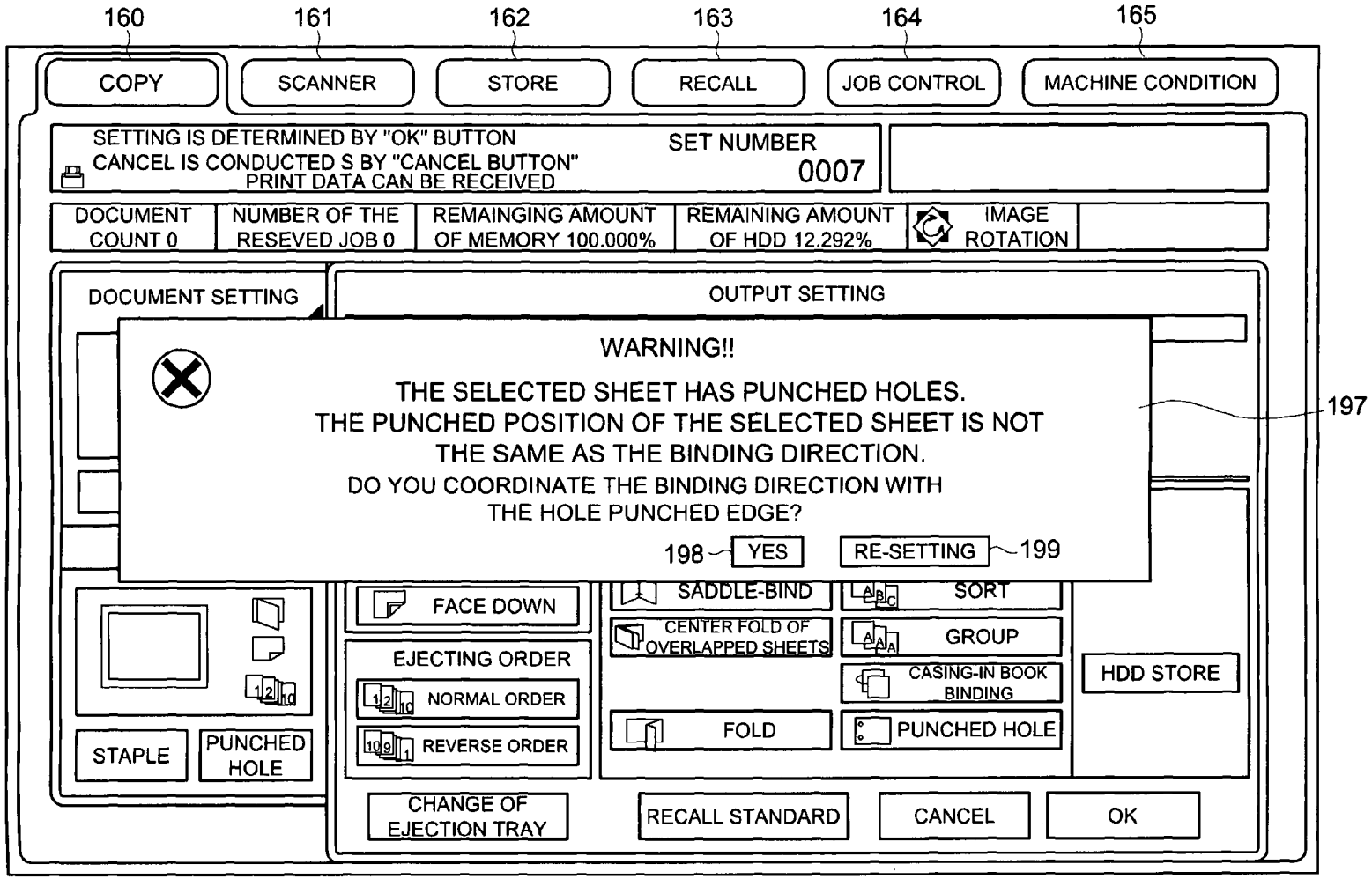
FIG. 15 shows a selection screen which is displayed when the binding direction does not match the punched hole position in the second embodiment.

FIG. 15 is a schematic drawing of the selection screen showing that the binding direction is not on the same as the punched hole position. On the interactive screen shown in FIG. 11, after OK button 195 is depressed to determine other settings, CPU 102*a* conducts the determination of S02-S04, and if the binding is not on the same edge as the punched holes, CPU 102*a* displays selection pop-up window 197 shown in FIG. 15.

On selection pop-up window 197, displayed are that the selected sheet has punched holes, the binding is not on the same as the hole punched edge, and whether to coordinate the binding on the same edge as the hole punched edge. "Yes" button 198 and re-setting button 199 are displayed in selection pop-up window 197. After yes button 198 is depressed, the coordination of the binding direction with the hole punched edge is selected. After re-setting button 199 is depressed, re-setting of the output setting is selected.

If yes button 198 is not depressed on selection pop-up window 197 (No in S22), that is, if re-setting button 199 is depressed, CPU 102*a* does not start image formation, but returns the display to the primary screen to instruct the re-setting to the operator, and the procedure returns to S01. On the other hand, if yes button 198 is depressed on selection pop-up window 197 (Yes in S22), CPU 102*a* forcibly conducts automatic setting of the binding direction onto the punched hole position on the sheet media, whereby the image formation is started (S06).

For example, after the portrait type document is read, the operator selects the LEF transfer sheet, carrying punched holes on its left edge, as a sheet media for image formation, the operator then inputs the double-surface print and the top edge binding. In the above case, since the punched hole position is not the same as the selected binding direction, selection pop-up window 197 is displayed. When yes button 198 is depressed on selection pop-up window 197, the binding direction is automatically set to be on the same edge as the punched holes.

By the above automatic setting, concerning the image to be formed on the front surface of the sheet media, the top of the image meets the top of the sheet media, whereby CPU 102*a* does not rotate the image of the front surface. Concerning the image to be formed on the rear surface of the sheet media, the bottom edge of the sheet media is the leading edge for conveyance, whereby CPU 102*a* rotates the image by 180° for the rear surface.

If the top edge binding is forcibly conducted, the image to be formed on the rear surface is not rotated, and image formation is conducted while the bottom edge of the sheet media meets the top edge of the image. In the case that the printed matters have been bound while using the holes punched on the left edge of the sheet media, the reader views an upside-down image on the rear surface of the sheet media.

On the other hand, in the case that the image formation is conducted, after the binding direction is automatically set on the same edge as the punched holes, the image formed on the rear surface is rotated 180° so that the bottom edge of the sheet media meets the bottom of the formed image. When the printed matters are bound while using the holes punched on the left edge of the sheet media, the reader can view an electing image on the rear surface of the sheet media.

For example, after the portrait type document is read, the operator selects the LEF transfer sheet, carrying punched holes on its top edge, as a sheet media for image formation, the operator then inputs the double-surface print and the left-right edge binding. In the above case, since the punched hole position is not the same as the selected binding direction, selection pop-up window 197 is displayed. When yes button 198 is depressed on selection pop-up window 197, the binding direction is automatically set to coordinate with the punched hole position.

In the above automatic setting, since the top of the image on the front surface meets the top edge of the sheet media, CPU 102*a* does not rotate the image. Further, CPU 102 does not also rotate the image on the rear surface, because the bottom edge of the sheet media is the leading edge for the conveyance, and the top of the image meets the bottom edge of the sheet media.

If the left-right binding is forcibly conducted, the image to be formed on the rear surface is rotated 180° so that the bottom edge of the sheet media meets the top of the formed image. When the printed matters are bound while using the holes punched on the top edge of the sheet media, the reader views the upside-down image on the rear surface of the sheet media.

On the other hand, in the case that the image formation is conducted, after the binding direction is automatically set on the same edge as the punched holes, the image formed on the rear surface is not rotated so that the bottom edge of the sheet media meets the top of the formed image. When the printed matters are bound while using the holes punched on the top edge of the sheet media, the reader can view an electing image on the rear surface of the sheet media.

Accordingly, on image forming apparatus 100 of the present embodiment, in the case that the image formation is conducted on the sheet media carrying punched holes, if the binding direction, which is set as an output format, is not on the same edge as the punched holes, CPU 102*a* displays the selection screen to select automatic setting or not, and if the automatic setting is selected by the operator, the preference is given to the punched hole position, that is, the binding direction is automatically set to coordinate with the punched hole position. Due to this, the output setting is perfectly conducted having the sameness between the punched hole position and the binding direction. Accordingly, book binding using the punched holes or a booklet bound by the punched holes can be produced.

The Third Embodiment

Next, detailed is image forming apparatus 100 relating to the third embodiment which prevents non-equality of the punched hole position on the sheet media and the binding direction. In the image forming apparatus 100 relating to the third embodiment, if the binding direction is not on the same edge as the punched holes, preference is given to the punched hole position, that is, the image is rotated so that the binding direction meets the punched hole position. This automatic setting is forcibly conducted.

Figure 16:
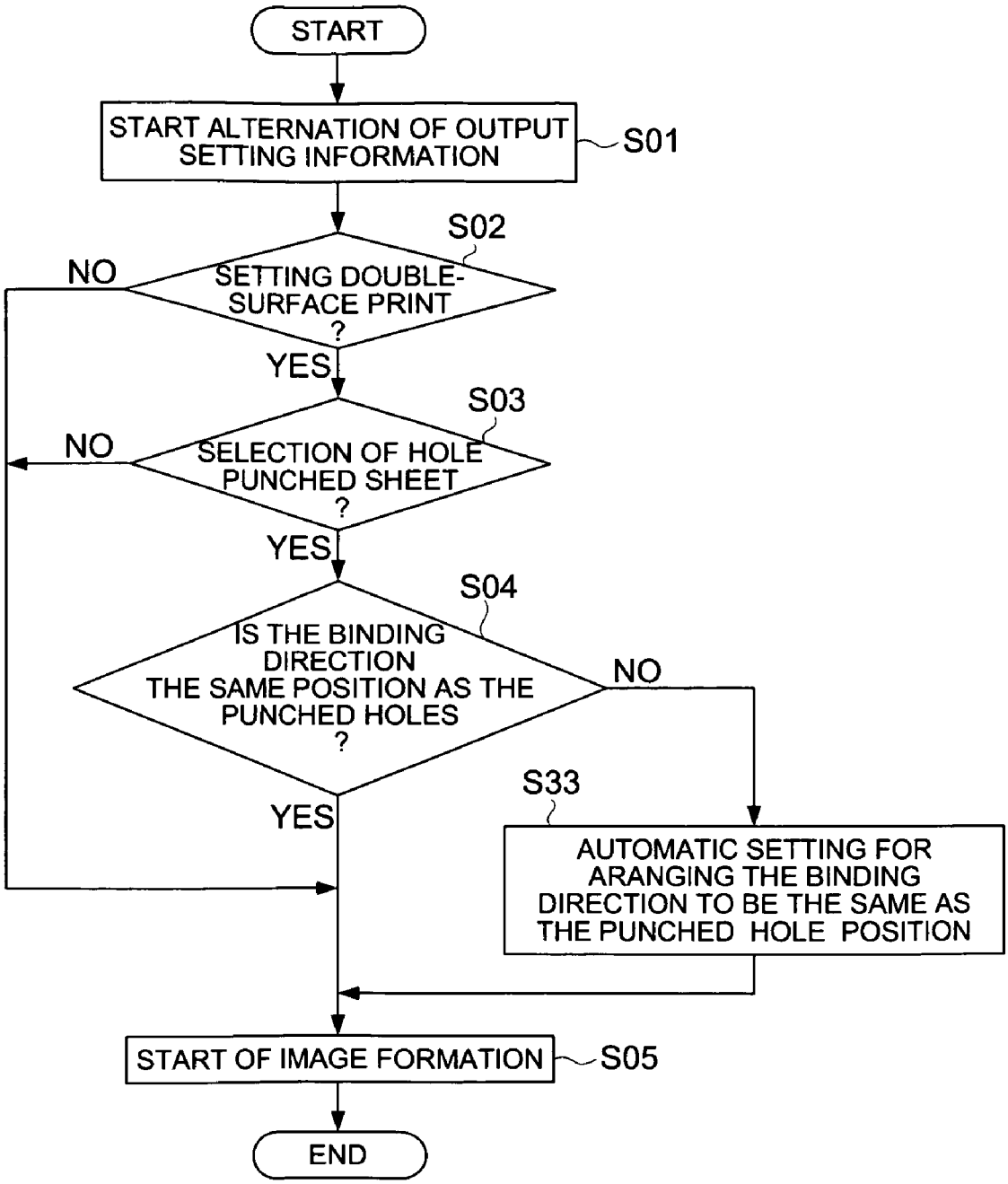
FIG. 16 is a flow chart showing the process from changing output setting information to starting of image formation, relating to a third embodiment.

FIG. 16 is a flow chart which shows the steps from the alternation of output setting information 151 to the start of image formation conducted by CPU 102*a* of the third embodiment. Since the alternation of sheet state information 150, the process of S01-S04 in FIG. 8 and the displayed screens of the first embodiment, are used in the same ways in the third embodiment, their explanation in the third embodiment is not detailed.

As shown in FIG. 16, the double-surface print is selected (Yes in S02), and the selected sheet media has the punched holes (Yes in S03), after which CPU 120*a* determines whether the binding direction of the printed matters is on the same as the punched hole position (S04). If the binding direction of the printed matters is on the same as the punched hole position (Yes in S04), CPU 102*a* reads the image to start image formation (S05), whereby the equality determining process is completed.

If the binding direction of the printed matters is not on the same as the punched hole position (No in S04), CPU 102*a* forcibly conduct automatic setting of the binding direction to be on the same edge as the punched holes (S33), and starts image formation (S05).

For example, after the portrait type document is read, the operator selects the LEF transfer sheet, carrying punched holes on its left edge as a sheet media for image formation, the operator then inputs the double-surface print and the top edge binding. However, since the binding direction is not on the same edge as the punched holes, CPU 102*a* forcibly conducts the setting of the binding direction to be on the same edge as the punched holes.

By the above automatic setting, concerning the image to be formed on the front surface of the sheet media, the top of the image meets the top of the sheet media, whereby CPU 102*a* does not rotate the image of the front surface. Concerning the image to be formed on the rear surface of the sheet media, the bottom edge of the sheet media is the leading edge for conveyance, whereby CPU 102*a* rotates the image by 180° for the rear surface.

If the top edge binding is forcibly conducted, the image to be formed on the rear surface is not rotated, and image formation is conducted while the bottom edge of the sheet media meets the top edge of the image. In the case that the printed matters have been bound while using the holes punched on the left edge of the sheet media, the reader views an upside-down image on the rear surface of the sheet media.

On the other hand, in the case that the image formation is conducted, after the binding direction is automatically set on the same edge as the punched holes, the image formed on the rear surface is rotated 180° so that the bottom edge of the sheet media meets the bottom of the formed image. When the printed matters are bound while using the holes punched on the left edge of the sheet media, the reader can view an electing image on the rear surface of the sheet media.

For example, after the portrait type document is read, the operator selects the LEF transfer sheet, carrying punched holes on its top edge, as a sheet media for image formation, the operator then inputs the double-surface print and the left-right edge binding. In the above case, since the punched hole position is not the same as the selected binding direction, the binding direction is automatically set to meet the punched hole position.

In the above automatic setting, since the top of the image on the front surface meets the top edge of the sheet media, CPU 102*a* does not rotate the image. Further, CPU 102 does not also rotate the image on the rear surface, because the bottom edge of the sheet media is the leading edge for the conveyance, and the top of the image meets the bottom edge of the sheet media.

If the left-right binding is forcibly conducted, the image to be formed on the rear surface is rotated 180° so that the bottom edge of the sheet media meets the top of the formed image. When the printed matters are bound while using the holes punched on the top edge of the sheet media, the reader views the upside-down image on the rear surface of the sheet media.

On the other hand, in the case that the image formation is conducted, after the binding direction is automatically set on the same edge as the punched holes, the image to be formed on the rear surface is not rotated so that the bottom edge of the sheet media meets the top of the formed image. When the printed matters are bound while using the holes punched on the top edge of the sheet media, the reader can view an electing image on the rear surface of the sheet media.

Accordingly, on image forming apparatus 100 of the present embodiment, in the case that the image formation is conducted on the sheet media carrying punched holes, if the binding direction, which is set as an output format, is not on the same edge as the punched holes, the preference is given to the punched hole position, that is, the binding direction is forcibly ad automatically set to meet the punched hole position. Due to this, the output setting is perfectly conducted having the sameness between the punched hole position and the binding direction. Accordingly, book binding using the punched holes or a booklet bound by the punched holes can be produced.

What is claimed is:

1. An image forming apparatus for forming an image on sheet media, comprising:

a memory section which memorizes a position of holes previously punched on the sheet media;

an operation section which is operable to select the sheet media to be used for image formation, a double-surface print operation, and a binding direction, the binding direction being selectable via the operation section independently of the position of the holes previously punched on the sheet media; and a control section which determines whether the position of the holes previously punched on the selected sheet media is coordinated with the binding direction selected via the operation section independently of the position of the holes previously punched on the sheet media, after the sheet media previously punched and the double-surface print operation have been selected via the operation section, and wherein the control section interrupts starting operation of the image formation, and warns an operator that the position of the holes previously punched on the selected sheet media is not coordinated with the selected binding direction, if it is determined that the position of the holes previously punched on the selected sheet media is not coordinated with the selected binding direction.

2. The image forming apparatus of claim 1, wherein the operation section is capable of setting previously the position of the punched holes selected from among left, right, top and bottom edges of the sheet media.

3. The image forming apparatus of claim 1, wherein the operation section is capable of setting previously the position of the punched holes selected from a position along a long edge or a position along a short edge of the sheet media.

4. The image forming apparatus of claim 1, wherein the control section warns the operator that the position of the holes previously punched on the selected sheet media is not coordinated with the selected binding direction and requests the operator to change a setting for image formation, if it is determined that the position of the holes previously punched on the selected sheet media is not coordinated with the selected binding direction.

5. An image forming apparatus for forming an image on sheet media, comprising:

a memory section which memorizes a position of holes previously punched on the sheet media;

an operation section which is operable to select the sheet media to be used for image formation, a double-surface print operation, and a binding direction, the binding direction being selectable via the operation section independently of the position of the holes previously punched on the sheet media;

a display section which displays a screen; and a control section which determines whether the position of the holes previously punched on the selected sheet media is coordinated with the binding direction selected via the operation section independently of the position of the holes previously punched on the sheet media, after the sheet media previously punched and the double-surface print operation have been selected via the operation section;

wherein the control section controls the display section to display a screen for selection by an operator of whether the binding direction is automatically set to be coordinated with the position of the holes previously punched on the sheet media, if it is determined that the position of the holes is not coordinated with the binding direction; and wherein if the operator selects the automatic setting of the binding direction to be coordinated with the position of the holes previously punched on the sheet media, the control section performs the image formation after automatically setting the binding direction to be coordinated with the position of the holes previously punched on the sheet media.

6. The image forming apparatus of claim 5, wherein the control section controls the display section to display a screen for section by the operator to select whether the binding the direction is automatically set to be coordinated with the position of the holes previously punched on the sheet media or a setting for image formation is changed, if it is determined that the position of the wholes is not coordinated with the binding direction; and wherein the control section interrupts starting operation of the image formation and controls the display section to display a screen for reset of the setting for image formation if the operator selects changing of the setting for image formation.

7. An image forming apparatus for forming an image on sheet media, comprising:

a memory section which memorizes a position of holes previously punched on the sheet media;

an operation section which is operable to select the sheet media to be used for image formation, a double-surface print operation, and a binding direction, the binding direction being selectable via said operation section independently of the position of the holes previously punched on the sheet media; and a control section which determines whether the position of the holes previously punched on the selected sheet media is coordinated with the binding direction selected via the operation section independently of the position of the holes previously punched on the sheet media, after the sheet media previously punched and the double-surface print operation have been selected via the operation section;

wherein if the position of the holes previously punched on the selected sheet media is not coordinated with the selected binding direction, the control section automatically sets the binding direction to be coordinated with the position of the holes previously punched on the selected sheet media; and wherein the control section conducts the image formation after automatically setting the binding direction to be coordinated with the position of the holes previously punched on the selected sheet media, if the position of the holes previously punched on the selected sheet media is not coordinated with the selected binding direction.

* * * * *